US011040556B2

(12) United States Patent
Takata

(10) Patent No.: US 11,040,556 B2
(45) Date of Patent: Jun. 22, 2021

(54) PRINTING APPARATUS WITH PLURALITY OF SHEET FEED TRAYS

(71) Applicant: RISO KAGAKU CORPORATION, Tokyo (JP)

(72) Inventor: Atsushi Takata, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/539,152

(22) Filed: Aug. 13, 2019

(65) Prior Publication Data

US 2020/0070549 A1 Mar. 5, 2020

(30) Foreign Application Priority Data

Aug. 30, 2018 (JP) ..... JP2018-161375
Jul. 29, 2019 (JP) ..... JP2019-138850

(51) Int. Cl.
*B41J 13/10* (2006.01)
*B41J 13/00* (2006.01)

(52) U.S. Cl.
CPC ..... *B41J 13/0036* (2013.01); *B41J 13/106* (2013.01)

(58) Field of Classification Search
CPC ..... B41J 13/106; B41J 13/0036
See application file for complete search history.

(56) References Cited

U.S. PATENT DOCUMENTS 10,104,248 B2 * 10/2018 Abe ..... G06F 3/1285

FOREIGN PATENT DOCUMENTS

JP 2015-212028 A 11/2015

* cited by examiner

*Primary Examiner* — Lamson D Nguyen
(74) *Attorney, Agent, or Firm* — Greenblum & Bernstein, P.L.C.

(57) ABSTRACT

A printing apparatus includes: a printer; a sheet feeder including sheet feed trays; a sheet discharger to discharge and hold sheets printed by the printer; and a controller. Upon unloading of the sheets from the sheet discharger, the controller: determines whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray; and, upon determining to perform the switching, controls the sheet feeder to switch the sheet feed source from the first sheet feed tray to the second sheet feed tray.

20 Claims, 14 Drawing Sheets

PRINTING APPARATUS WITH PLURALITY OF SHEET FEED TRAYS

CROSS REFERENCE TO RELATED APPLICATION

This application is based upon and claims the benefit of priority from the prior Japanese Patent Application Nos. 2018-161375, filed on Aug. 30, 2018, and 2019-138850, filed on Jul. 29, 2019, the entire contents of which are incorporated herein by reference.

BACKGROUND

1. Technical Field

The present disclosure relates to a printing apparatus which performs printing on sheets.

2. Related Art

Japanese Patent Application Publication No. 2015-212028 proposes a printing apparatus including a sheet discharge tray which can hold many sheets subjected to printing and discharged.

Moreover, among such printing apparatuses, there is an apparatus including a mechanism which automatically unloads the sheets stacked on the sheet discharge tray from the sheet discharge tray. The printing apparatus including such a mechanism can continuously perform a print operation even when the sheet discharge tray becomes full, by automatically unloading the sheets stacked on the sheet discharge tray.

SUMMARY

Even in the apparatus including the mechanism which automatically unloads the sheets from the sheet discharge tray as described above, there are cases where the print operation stops due to running-out of sheets in the sheet feed tray and the apparatus has to wait for a user to supply the sheets. This leads to a decrease in printed sheet productivity.

The disclosure is directed to a printing apparatus which can reduce a decrease in printed sheet productivity.

A printing apparatus in accordance with some embodiments includes: a printer configured to perform printing on sheets; a sheet feeder including sheet feed trays and configured to feed the sheets from a selected one of the sheet feed trays to the printer; a sheet discharger configured to discharge and hold the sheets printed by the printer; and a controller. Upon unloading of the sheets from the sheet discharger, the controller is configured to: determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray; and upon determining to perform the switching, control the sheet feeder to switch the sheet feed source from the first sheet feed tray to the second sheet feed tray.

According to the aforementioned configuration, a decrease in printed sheet productivity can be reduced.

DETAILED DESCRIPTION

Figure 1:
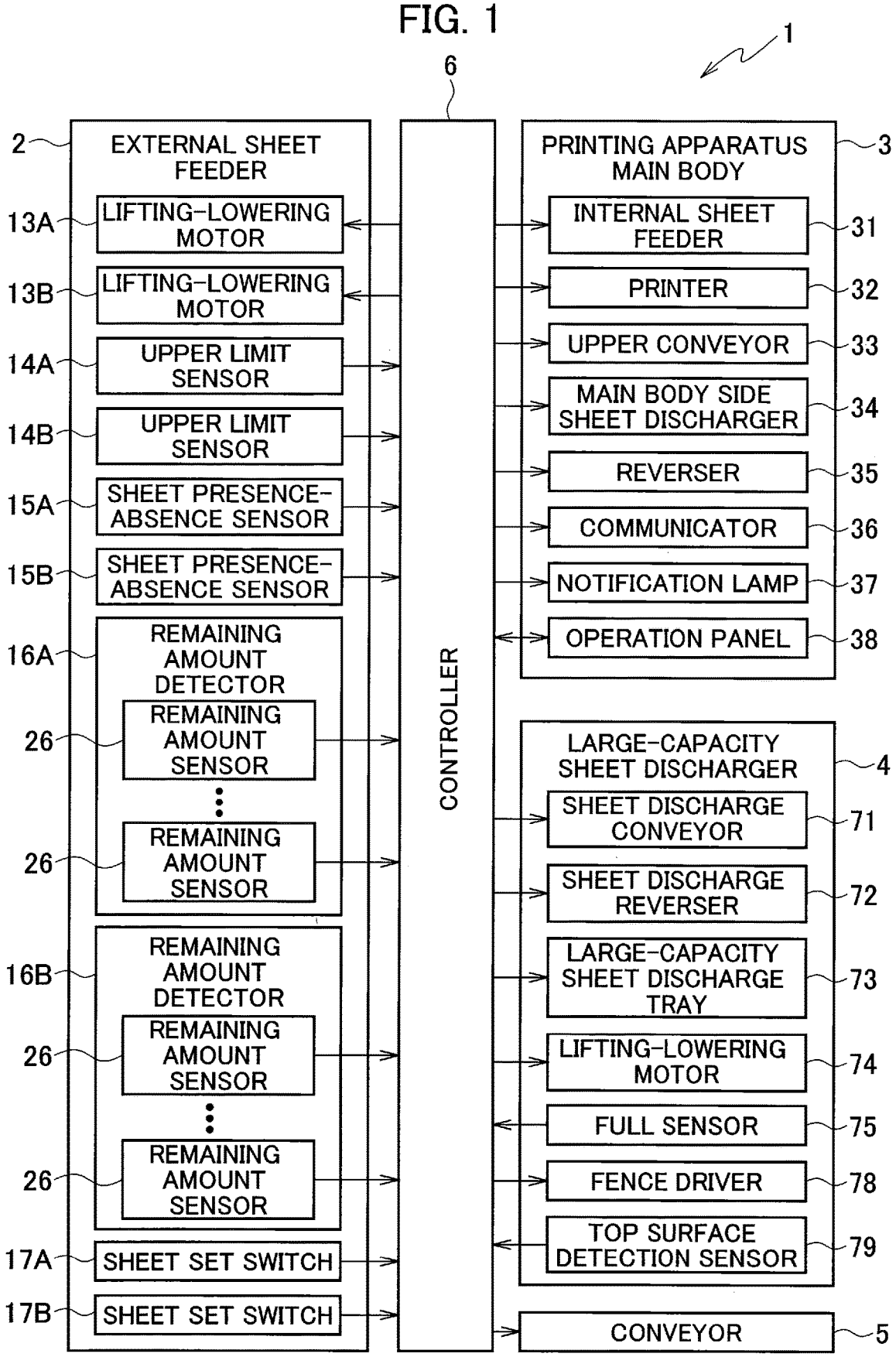
FIG. 1 is a block diagram illustrating a configuration of a printing apparatus according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
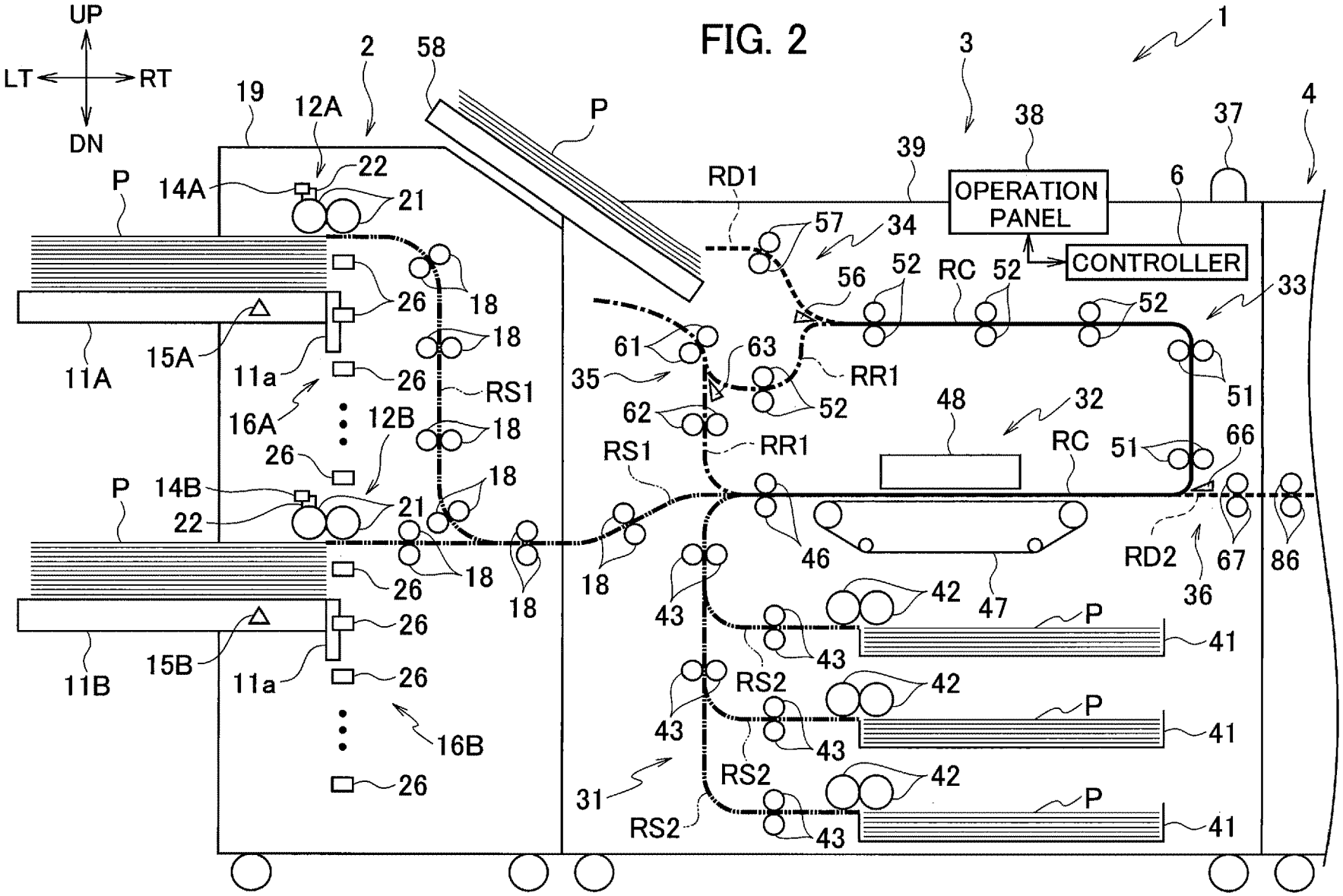
FIG. 2 is a schematic configuration diagram of an external sheet feeder and a printing apparatus main body of the printing apparatus illustrated in FIG. 1.
Figure 3:
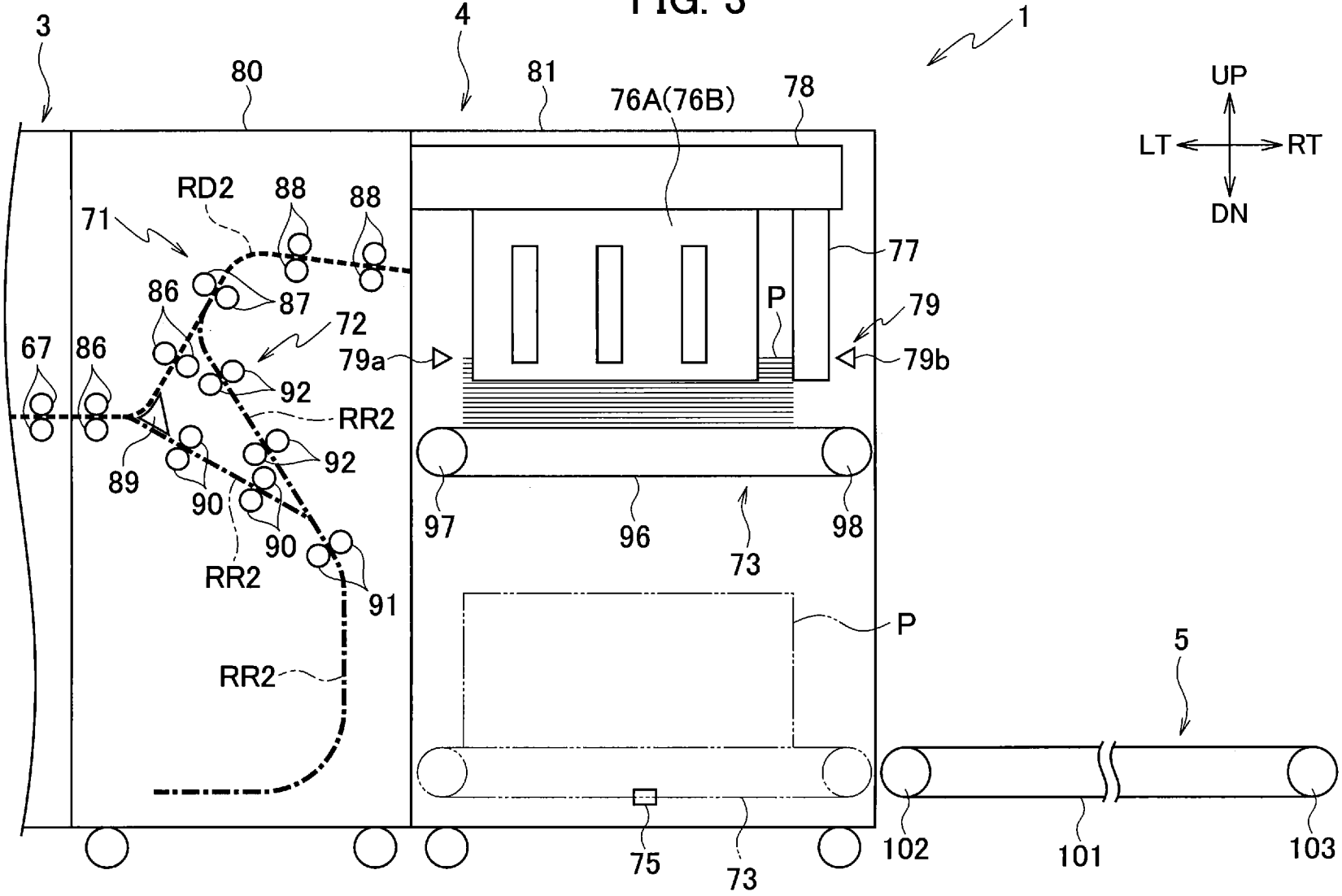
FIG. 3 is a schematic configuration diagram of a large-capacity sheet discharger and an unloader of the printing apparatus illustrated in FIG. 1.

FIG. 1 is a block diagram illustrating a configuration of a printing apparatus 1 according to a first embodiment. FIG. 2 is a schematic configuration diagram of an external sheet feeder 2 and a printing apparatus main body 3 in the printing apparatus 1 illustrated in FIG. 1. FIG. 3 is a schematic configuration diagram of a large-capacity sheet discharger 4 and a conveyor 5 in the printing apparatus 1 illustrated in FIG. 1. In the following description, a direction orthogonal to the sheet surfaces of FIGS. 2 and 3 are referred to as front-rear direction. Moreover, up, down, left, and right in the sheet surfaces of FIGS. 2 and 3 are referred to as directions of up, down, left, and right. In FIGS. 2 and 3, the directions of right, left, up, and down are denoted by RT, LT, UP, and DN, respectively.

Routes illustrated by bold lines in FIGS. 2 and 3 are conveyance routes through which sheets P being print media are conveyed. Among the conveyance routes, a route illustrated by a solid line is a normal route RC. Routes illustrated by broken lines are a main body side sheet discharge route RD1 and a large-capacity sheet discharge route RD2. Routes illustrated by one-dot chain lines are a sheet reverse refeed route RR1 and a sheet discharge reverse route RR2. Routes illustrated by two-dot chain lines are an external sheet feed route RS1 and an internal sheet feed route RS2. Upstream and downstream in the following description mean upstream and downstream in the conveyance routes.

As illustrated in FIGS. 1 to 3, the inkjet printing apparatus 1 according to the first embodiment includes the external sheet feeder (sheet feeder) 2, the printing apparatus main body 3, the large-capacity sheet discharger (sheet discharger) 4, the conveyor 5, and a controller 6.

The external sheet feeder 2 feeds the sheets P to a printer 32 of the printing apparatus main body 3 to be described later. The external sheet feeder 2 includes external sheet feed trays (sheet feed trays) 11A, 11B, external sheet feed roller units 12A, 12B, lifting-lowering motors 13A, 13B, upper limit sensors 14A, 14B, sheet presence-absence sensors 15A, 15B, remaining amount detectors 16A, 16B, sheet set switches 17A, 17B, multiple pairs of external sheet feed conveyance rollers 18, and an external sheet feeder case 19 housing or holding the units of the external sheet feeder 2. Note that the external sheet feed trays 11A, 11B and the like are sometimes collectively referred to by omitting the alphabets attached to the reference numerals.

The external sheet feed trays 11 are trays on which the sheets P used for printing are stacked. The external sheet feed trays 11 are configured to be capable of being lifted and lowered. The external sheet feed trays 11A, 11B are arranged one on top of another in the up-down direction. The external sheet feed tray 11B is installed below the external sheet feed tray 11A. The external sheet feed trays 11A, 11B are selectively used as a sheet feed source of the printer 32.

Each external sheet feed tray 11 is provided with a detection target plate 11*a*. The detection target plate 11*a* is a member to be detected by remaining amount sensors 26 of a remaining amount detector 16 to be described later.

The external sheet feed roller units 12A, 12B pick up the sheets P stacked on the external sheet feed trays 11A, 11B and send them toward the printing apparatus main body 3 (to the right). Each external sheet feed roller unit 12 includes a pair of external sheet feed rollers 21 and a detection target plate 22.

The upstream (left) external sheet feed roller 21 in each pair of external sheet feed rollers 21 comes into pressure contact with the top (uppermost) sheet P among the sheets P stacked on the external sheet feed tray 11 and picks up the sheet P to send it to the right by means of friction force. The upstream external sheet feed roller 21 is configured to be capable of achieving sheet feeding pressure at which the sheet P can be picked up when a top surface position of the sheets P (height position of the top sheet P) on the external sheet feed tray 11 is at a predetermined sheet feed position. The upstream external sheet feed roller 21 moves up and down within a certain range depending on fluctuation in the position (height) of the top sheet P.

The upstream external sheet feed roller 21 is rotationally driven by a not-illustrated motor. A not-illustrated drive force transmission mechanism transmits rotational drive force of the motor from the upstream external sheet feed roller 21 to the downstream external sheet feed roller 21 and the paired external sheet feed rollers 21 thereby rotate.

The downstream (right) external sheet feed roller 21 out of the paired external sheet feed rollers 21 guides the sheet P sent by the upper external sheet feed roller 21 between itself and a not-illustrated friction pad and sends the sheet P to the right.

The detection target plate 22 is a member provided to be used by the upper limit sensor 14 to detect that the top surface position of the sheets P on the external sheet feed tray 11 is at the sheet feed position. The sheet feed position is a position set as the height position of the top sheet P in the case where the upstream external sheet feed roller 21 picks up the top sheet P on the external sheet feed tray 11. The detection target plate 22 moves up and down depending on upward and downward movement of the upstream external sheet feed roller 21.

The lifting-lowering motors 13A, 13B lift and lower the external sheet feed trays 11A, 11B, respectively.

The upper limit sensors 14A, 14B are sensors which detect that the top surface positions of the sheets P on the external sheet feed trays 11A, 11B are at the sheet feed positions. Each upper limit sensor 14 is arranged to detect the detection target plate 22 when the top sheet P on the external sheet feed tray 11 is at the sheet feed position. When the top sheet P on the external sheet feed tray 11 is below the sheet feed position, the detection target plate 22 is moved downward together with the upstream external sheet feed roller 21. In this case, the upper limit sensor 14 does not detect the detection target plate 22.

A state where the upper limit sensor 14 detects the detection target plate 22 and thus detects that the top surface position of the sheets P on the external sheet feed tray 11 is at the sheet feed position is referred to as on. Moreover, a state where the upper limit sensor 14 does not detect the detection target plate 22 and thus does not detect that the top surface position of the sheets P on the external sheet feed tray 11 is at the sheet feed position is referred to as off.

The sheet presence-absence sensors 15A, 15B detect presence or absence of the sheets P on the external sheet feed trays 11A, 11B, respectively. A state where each sheet presence-absence sensor 15 detects that there are sheets P on the external sheet feed tray 11 is referred to as on. A state where the sheet presence-absence sensor 15 does not detect that there are sheets P on the external sheet feed tray 11 is referred to as off.

The remaining amount detectors 16A, 16B are sensors used to detect sheet remaining amounts which are amounts of sheets P stacked on the external sheet feed trays 11A, 11B, respectively. Each remaining amount detector 16 includes multiple remaining amount sensors 26.

The multiple remaining amount sensors 26 detect the height position of the external sheet feed tray 11 by detecting the detection target plate 11*a*. The multiple remaining amount sensors 26 are arranged one on top of the other in the up-down direction. The positions of the respective remaining amount sensors 26 are set such that a range of the sheet remaining amount and a lower limit position (sheet supply position) of the external sheet feed tray 11 can be determined from the states of detection of the detection target plate 11*a* in the respective remaining amount sensors 26 (whether the detection target plate 11*a* is detected). The lower limit position of the external sheet feed tray 11 is a position set as a height position of the external sheet feed tray 11 in the case where a user supplies the sheets P to the external sheet feed tray 11.

The sheet set switches 17 are switches which the user operates when the user supplies the sheets P to the external sheet feed trays 11 and the external sheet feed trays 11 are to be moved to the upper limit positions. The upper limit position of each external sheet feed tray 11 is a height position of the external sheet feed tray 11 in the case where the top surface position of the sheets P on the external sheet feed tray 11 is at the sheet feed position. The sheet set switches 17A, 17B correspond respectively to the external sheet feed trays 11A, 11B.

The external sheet feed conveyance rollers 18 convey the sheets P, picked up from the external sheet feed trays 11A, 11B, toward registration rollers 46 of the printing apparatus main body 3 to be described later. The external sheet feed conveyance rollers 18 are arranged along the external sheet feed route RS1. One pair of the external sheet feed conveyance rollers 18 is arranged in a main body case 39 of the printing apparatus main body 3 to be described later. The external sheet feed conveyance rollers 18 are rotationally driven by a not-illustrated motor.

The printing apparatus main body 3 performs printing on the sheets P. The printing apparatus main body 3 includes an internal sheet feeder 31, the printer 32, an upper conveyor 33, a main body side sheet discharger 34, a reverser 35, a communicator 36, a notification lamp (notifier) 37, an operation panel 38, and the main body case 39 housing or holding the units of the printing apparatus main body 3.

The internal sheet feeder 31 feeds the sheets P to the printer 32 in the printing apparatus main body 3. The internal sheet feeder 31 includes multiple internal sheet feed trays 41, multiple pairs of internal sheet feed rollers 42, and multiple pairs of internal sheet feed conveyance rollers 43.

The internal sheet feed trays 41 are trays on which the sheets P to be used in printing are stacked. The internal sheet feed trays 41 are arranged in the main body case 39.

The internal sheet feed rollers 42 pick up the sheets P from the internal sheet feed trays 41 and send them to the internal sheet feed route RS2. The internal sheet feed rollers 42 are rotationally driven by a not-illustrated motor.

The internal sheet feed conveyance rollers 43 convey the sheets P picked up from the internal sheet feed trays 41 toward the registration rollers 46 to be described later. The internal sheet feed conveyance rollers 43 are arranged along the internal sheet feed route RS2. The internal sheet feed conveyance rollers 43 are rotationally driven by a not-illustrated motor.

The printer 32 prints images on the sheets P while conveying the sheets P. The printer 32 includes a pair of registration rollers 46, a belt platen portion 47, and an inkjet head portion 48.

The registration rollers 46 temporarily stops each of the sheets P conveyed from any of the external sheet feeder 2, the internal sheet feeder 31, and the reverser 35 to correct skewing and then conveys the sheet P toward the belt platen portion 47. The registration rollers 46 are arranged on the normal route RC near a merging point of the external sheet feed route RS1, the internal sheet feed route RS2, and the sheet reverse refeed route RR1. The registration rollers 46 are rotationally driven by a not-illustrated motor.

The belt platen portion 47 conveys the sheets P conveyed from the registration rollers 46 while sucking and holding the sheets P on a belt.

The inkjet head portion 48 includes a line inkjet head (not illustrated) in which multiple nozzles are aligned in a direction (front-rear direction) substantially orthogonal to the conveyance direction of the sheets P. The inkjet head portion 48 is arranged above the belt platen portion 47. The inkjet head portion 48 prints images on the sheets P conveyed by the belt platen portion 47 by ejecting ink from the inkjet head to the sheets P.

The upper conveyor 33 conveys the sheets P conveyed by the belt platen portion 47 such that the sheets P are turned around to be conveyed from right to left. The upper conveyor 33 includes multiple pairs of upward conveyance rollers 51 and multiple pairs of horizontal conveyance rollers 52.

The upward conveyance rollers 51 convey the sheets P, conveyed by the belt platen portion 47, to the horizontal conveyance rollers 52 above the upward conveyance rollers 51. The upward conveyance rollers 51 are arranged in an upward conveyance portion in an intermediate section of the normal route RC. The upward conveyance rollers 51 are rotationally driven by a not-illustrated motor.

The horizontal conveyance rollers 52 convey the sheets P, conveyed by the upward conveyance rollers 51, to the main body side sheet discharger 34 or the reverser 35. The most downstream pair of horizontal conveyance rollers 52 is arranged in an upstream portion of the sheet reverse refeed route RR1. The other horizontal conveyance rollers 52 are arranged along a horizontal portion in a downstream section of the normal route RC. The horizontal conveyance rollers 52 are rotationally driven by a not-illustrated motor.

The main body side sheet discharger 34 discharges the sheets P subjected to printing in the printer 32. The main body side sheet discharger 34 includes a switching unit 56, a pair of sheet discharge rollers 57, and a sheet discharge tray 58.

The switching unit 56 switches the conveyance route of the sheets P between the main body side sheet discharge route RD1 and the sheet reverse refeed route RR1. The switching unit 56 is arranged at a branching point between the main body side sheet discharge route RD1 and the sheet reverse refeed route RR1.

The sheet discharge rollers 57 convey the sheets P guided toward the main body side sheet discharge route RD1 by the switching unit 56 and discharge the sheets P to the sheet discharge tray 58. The sheet discharge rollers 57 are arranged between the switching unit 56 and the sheet discharge tray 58 in the main body side sheet discharge route RD1. The sheet discharge rollers 57 are rotationally driven by a not-illustrated motor.

The sheet discharge tray 58 is a tray on which the sheets P subjected to printing and discharged by the sheet discharge rollers 57 are stacked.

The reverser 35 reverses the sheets P subjected to printing on the front side and conveys the sheets P to the registration rollers 46 in duplex printing. The reverser 35 includes a pair of reverse rollers 61, a pair of sheet refeed rollers 62, and a switching gate 63.

The reverse rollers 61 switch back the sheets P conveyed by the horizontal conveyance rollers 52 of the upper conveyor 33 and convey the sheets P to the sheet refeed rollers 62. The reverse rollers 61 are configured to be rotatable in forward and reverse directions to perform switch back conveyance of the sheets P. The reverse rollers 61 are arranged between the most downstream pair of horizontal conveyance rollers 52 and the pair of sheet refeed rollers 62 in the sheet reverse refeed route RR1. The reverse rollers 61 are rotationally driven by a not-illustrated motor.

The sheet refeed rollers 62 convey the sheets P switched back by the reverse rollers 61 to the registration rollers 46. The sheet refeed rollers 62 are arranged between the pair of reverse rollers 61 and the pair of registration rollers 46 in the sheet reverse refeed route RR1. The sheet refeed rollers 62 are rotationally driven by a not-illustrated motor.

The switching gate 63 guides the sheets P, conveyed by the horizontal conveyance rollers 52, to the reverse rollers 61. Moreover, the switching gate 63 guides the sheets P, switched back by the reverse rollers 61, to the sheet refeed rollers 62. The switching gate 63 is arranged near the center of mass of three portions of the most downstream pair of horizontal conveyance rollers 52, the pair of reverse rollers 61, and the pair of sheet refeed rollers 62.

The communicator 36 sends the sheets P subjected to printing in the printer 32 to a large-capacity sheet discharger 4. The communicator 36 includes a switching unit 66 and a pair of communication rollers 67.

The switching unit 66 switches the conveyance route of the sheets P between the normal route RC and the large-capacity sheet discharge route RD2. The switching unit 66 is arranged at a branching point between the normal route RC and the large-capacity sheet discharge route RD2. The large-capacity sheet discharge route RD2 is a route which branches from the normal route RC and extends to a large-capacity sheet discharge tray 73 to be described later.

The communication rollers 67 convey the sheets P conveyed from the belt platen portion 47 and sent the sheets P to the large-capacity sheet discharger 4. The communication rollers 67 are arranged downstream of the switching unit 66 in the large-capacity sheet discharge route RD2. The communication rollers 67 are rotationally driven by a not-illustrated motor.

The notification lamp 37 notifies the user of time (a timing) to supply the sheets P to the external sheet feed tray 11. The notification lamp 37 is installed on the main body case 39. Note that, the notification lamp 37 may be installed in the external sheet feeder case 19 or the like as long as the notification lamp 37 is located at a position visible to the user.

The operation panel 38 displays input screens and the like and receives input operations made by the user. The operation panel 38 includes a display unit (not illustrated) including a liquid crystal display panel or the like and an input unit (not illustrated) including various operation keys, a touch panel, and the like.

The large-capacity sheet discharger 4 discharges and holds the sheets P subjected to printing in the printer 32 of the printing apparatus main body 3. The large-capacity sheet discharger 4 includes a sheet discharge conveyor 71, a sheet discharge reverser 72, the large-capacity sheet discharge tray 73, a lifting-lowering motor 74, a full sensor 75, a pair of side fences 76A, 76B, an end fence 77, a fence driver 78, a top surface detection sensor 79, a sheet discharge conveyance side case 80 housing the sheet discharge conveyor 71 and the like, and a sheet discharge side case 81 housing the large-capacity sheet discharge tray 73 and the like.

The sheet discharge conveyor 71 discharges the sheets P subjected to printing and sent out by the communicator 36 and stacks the sheets P on the large-capacity sheet discharge tray 73. The sheet discharge conveyor 71 includes two pairs of introduction rollers 86, one pair of upward conveyance rollers 87, and two pairs of sheet discharge rollers 88.

The introduction rollers 86 introduce the sheets P subjected to printing and sent out from the printing apparatus main body 3 by the communicator 36, into the large-capacity sheet discharger 4. The introduction rollers 86 are arranged downstream of the communication rollers 67 along the large-capacity sheet discharge route RD2. The introduction rollers 86 are rotationally driven by a not-illustrated motor.

The upward conveyance rollers 87 convey the sheets P, conveyed by the introduction rollers 86 or intermediate rollers 92 to be described later, to the sheet discharge rollers 88 above the upward conveyance rollers 87. The upward conveyance rollers 87 are arranged near and downstream of a merging point of the large-capacity sheet discharge route RD2 and a downstream portion of the sheet discharge reverse route RR2, in the large-capacity sheet discharge route RD2. The upward conveyance rollers 87 are rotationally driven by a not-illustrated motor.

The sheet discharge rollers 88 convey the sheets P conveyed by the upward conveyance rollers 87 and discharge the sheets P to the large-capacity sheet discharge tray 73. The sheet discharge rollers 88 are arranged in a most-downstream portion of the large-capacity sheet discharge route RD2. The sheet discharge rollers 88 are rotationally driven by a not-illustrated motor.

The sheet discharge reverser 72 reverses the sheets P by causing the sheets P received from the large-capacity sheet discharge route RD2 to move back and forth in the sheet discharge reverse route RR2 and returning the sheets P to the large-capacity sheet discharge route RD2. The sheet discharge reverser 72 includes a switching unit 89, two pairs of reverse entrance rollers 90, one pair of reverse rollers 91, and two pairs of intermediate rollers 92.

The switching unit 89 switches the conveyance route of the sheets P between the large-capacity sheet discharge route RD2 and the sheet discharge reverse route RR2. The switching unit 89 is arranged at a branching point between the large-capacity sheet discharge route RD2 and the sheet discharge reverse route RR2.

The reverse entrance rollers 90 convey the sheets P, guided from the large-capacity sheet discharge route RD2 to the sheet discharge reverse route RR2 by the switching unit 89, to the reverse rollers 91. The reverse entrance rollers 90 are arranged along an upstream portion of the sheet discharge reverse route RR2. The reverse entrance rollers 90 are rotationally driven by a not-illustrated motor.

The reverse rollers 91 switch back the sheets P conveyed by the reverse entrance rollers 90 and convey the sheets P to the intermediate rollers 92. The reverse rollers 91 are configured to be capable of rotating in the forward and reverse direction to perform switch back conveyance of the sheets P. The reverse rollers 91 are arranged downstream of the reverse entrance rollers 90 in the sheet discharge reverse route RR2. The reverse rollers 91 are rotationally driven by a not-illustrated motor.

The intermediate rollers 92 convey the sheets P, switched back by the reverse rollers 91, to the upward conveyance rollers 87. The intermediate rollers 92 are arranged along a downstream portion of the sheet discharge reverse route RR2. The intermediate rollers 92 are rotationally driven by a not-illustrated motor.

The large-capacity sheet discharge tray 73 is a tray on which the sheets P subjected to printing and discharged by the sheet discharge conveyor 71 are stacked. The large-capacity sheet discharge tray 73 is arranged below and downstream of the sheet discharge rollers 88. The large-capacity sheet discharge tray 73 is configured to be capable of being lifted and lowered such that the larger the number of stacked sheets P is, the more the large-capacity sheet discharge tray 73 is lowered. Many sheets P can be stacked on the large-capacity sheet discharge tray 73.

Moreover, the large-capacity sheet discharge tray 73 is formed of a belt conveyor and is capable of sending out the sheets P, stacked on the large-capacity sheet discharge tray 73, to the conveyor 5. The large-capacity sheet discharge tray 73 includes an annular belt 96 on which the sheets P are mounted, a drive roller 97 which endlessly moves the belt 96, and a following roller 98 which rotates by following the belt 96. The belt 96 is wound around the drive roller 97 and the following roller 98. A not-illustrated motor rotationally drives the drive roller 97 to endlessly move the belt 96 and the sheets P stacked on an upper surface of the belt 96 are thereby moved.

The lifting-lowering motor 74 lifts and lowers the large-capacity sheet discharge tray 73.

The full sensor 75 detects that the large-capacity sheet discharge tray 73 is full of the sheets P. Specifically, the full sensor 75 detects the large-capacity sheet discharge tray 73 at a lower limit position which is a height position in the case where the maximum stackable number of sheets P are stacked on the large-capacity sheet discharge tray 73.

The paired side fences 76A, 76B restrict the positions of the sheets P discharged onto the large-capacity sheet discharge tray 73 in a width direction (front-rear direction). The side fences 76A, 76B are provided in a state suspended from the fence driver 78 above the large-capacity sheet discharge tray 73. The side fences 76A, 76B are arranged side by side at an interval in the front-rear direction.

The end fence 77 restricts the position of leading edges (right edges) of the sheets P discharged onto the large-capacity sheet discharge tray 73. The end fence 77 is provided in a state suspended from the fence driver 78 above the large-capacity sheet discharge tray 73.

The fence driver 78 moves the paired side fences 76A, 76B in directions toward and away from each other. Moreover, the fence driver 78 moves the end fence 77 in the left-right direction. The fence driver 78 is provided above the large-capacity sheet discharge tray 73.

The top surface detection sensor 79 detects the top surface position (height position of the top surface of the top sheet P) of the sheets P stacked on the large-capacity sheet discharge tray 73. The top surface detection sensor 79 is used to maintain the top surface position of the sheets P stacked on the large-capacity sheet discharge tray 73 around a specified height position in a sheet discharge operation. The specified height position is set in advance as a height position depending on a drop distance appropriate for orderly stacking the sheets P dropped from the sheet discharge rollers 88 onto the large-capacity sheet discharge tray 73. The top surface detection sensor 79 includes a light emitter 79*a* and a light receiver 79*b*.

The light emitter 79*a* and the light receiver 79*b* are arranged at an interval in the left-right direction with a region in which the sheets P are stacked on the large-capacity sheet discharge tray 73 located therebetween. The arrangement of the light emitter 79*a* in the height direction is such that an optical axis thereof is located at the specified height position and the light emitter 79*a* emits light rightward toward the light receiver 79*b*. The light receiver 79*b* receives light from the light emitter 79*a* when there are no sheets P between the light receiver 79*b* and the light emitter 79*a* and does not receive the light from the light emitter 79*a* when the light is blocked by the sheets P. Specifically, the top surface detection sensor 79 detects the sheets P by being set to a state where the light receiver 79*b* does not receive the light from the light emitter 79*a*. In this description, the state where the top surface detection sensor 79 detects the sheets P is referred to as on and the state where the top surface detection sensor 79 does not detect the sheets P is referred to as off.

The conveyor 5 unloads the sheets P stacked on the large-capacity sheet discharge tray 73 of the large-capacity sheet discharger 4 from the large-capacity sheet discharge tray 73 and holds the sheets P. The conveyor 5 is arranged near and on the right side of the large-capacity sheet discharger 4. The conveyor 5 is arranged at substantially the same height as the large-capacity sheet discharge tray 73 at the lower limit position.

The conveyor 5 is formed of a belt conveyor. The conveyor 5 includes an annular belt 101 on which the sheets P are stacked, a drive roller 102 which endlessly moves the belt 101, and a following roller 103 which rotates by following the belt 101. The belt 101 is wound around the drive roller 102 and the following roller 103. A not-illustrated motor rotationally drives the drive roller 102 to endlessly move the belt 101 and the belt 101 can thereby receive and unload the sheets P sent from the large-capacity sheet discharge tray 73. The conveyor 5 has a length capable of holding multiple piles of sheets P.

The controller 6 controls operations of the units of the printing apparatus 1. The controller 6 includes a CPU, a RAM, a ROM, a hard disk drive, and the like.

In a print operation in which the sheets P are fed from the external sheet feeder 2 and discharged to the large-capacity sheet discharger 4, the controller 6 determines whether to perform switching of the external sheet feed tray 11 being the sheet feed source, based on a sheet remaining amount Rp in the external sheet feed tray 11 which is the latest sheet feed source and a sheet remaining amount Rq in another external sheet feed tray 11 which is the other one of the external sheet feed trays 11 in unloading of the sheets P from the large-capacity sheet discharger 4. When determining to perform the switching of the sheet feed source, the controller 6 controls the external sheet feeder 2 such that the sheet feed source is switched from the external sheet feed tray 11 being the latest sheet feed source to the other external sheet feed tray 11.

Specifically, if the sheet remaining amount Rp in the external sheet feed tray 11 which is the latest sheet feed source is a supply reference value L or less and the sheet remaining amount Rq in another external sheet feed tray 11 is a sheet feed reference value A or more in unloading of the sheets P from the large-capacity sheet discharger 4, the controller 6 determines to perform the switching of the sheet feed source from the external sheet feed tray 11 being the latest sheet feed source to the other external sheet feed tray 11.

In this case, the supply reference value L is a value set in advance as a value of the sheet remaining amount at which the sheets P needs to be supplied. Moreover, the sheet feed reference value A is a value set in advance as a value of the sheet remaining amount sufficient for the sheet feeding.

Next, operations of the printing apparatus 1 are described.

Since the printing apparatus 1 of the first embodiment is characterized in the control of the external sheet feeder 2 in the case where the sheets P are fed from the external sheet feeder 2 and discharged to the large-capacity sheet discharger 4, description is given of a print operation of executing a print job in which the sheets P are fed from the external sheet feeder 2 and discharged to the large-capacity sheet discharger 4. In this print operation, it is assumed that the sheets P of the same type and the same size are stacked on the external sheet feed trays 11A, 11B of the external sheet feeder 2.

When the print operation is started, the sheets P not subjected to printing are conveyed one by one from one of the external sheet feed trays 11A, 11B of the external sheet feeder 2 to the printer 32. In the printer 32, the sheets P are conveyed to the belt platen portion 47 by the registration rollers 46. The sheets P are subjected to printing by the inkjet head portion 48 while being conveyed by the belt platen portion 47.

In the case of simplex printing, the sheets P subjected to printing on one sides are guided from the normal route RC to the large-capacity sheet discharge route RD2 by the switching unit 66 of the communicator 36. The sheets P guided to the large-capacity sheet discharge route RD2 are conveyed by the communication rollers 67 and the upstream introduction rollers 86 and are guided along the large-capacity sheet discharge route RD2 toward the downstream introduction rollers 86 by the switching unit 89 of the sheet discharge reverser 72. Then, the sheets P are conveyed along the large-capacity sheet discharge route RD2 by the introduction rollers 86, the upward conveyance rollers 87, and the sheet discharge rollers 88 and are discharged to the large-capacity sheet discharge tray 73.

When the sheets P printed on one sides are to be discharged to the large-capacity sheet discharge tray 73 with the print sides facing downward, the sheets P guided to the large-capacity sheet discharge route RD2 by the switching unit 66 are guided to the sheet discharge reverse route RR2 by the switching unit 89 of the sheet discharge reverser 72 while being conveyed by the communication rollers 67 and the upstream introduction rollers 86. The sheets P guided to the sheet discharge reverse route RR2 are conveyed to the reverse rollers 91 by the reverse entrance rollers 90 and are switched back by the reverse rollers 91. The switched-back sheets P are conveyed by the intermediate rollers 92 and are returned from the sheet discharge reverse route RR2 to the large-capacity sheet discharge route RD2. The sheets P are thereby turned upside down. Then, the sheets P are conveyed along the large-capacity sheet discharge route RD2 by the upward conveyance rollers 87 and the sheet discharge rollers 88 and are discharged to the large-capacity sheet discharge tray 73.

In the case of duplex printing, the sheets P subjected to printing on the front sides by the printer 32 are guided to the upper conveyor 33 by the switching unit 66 of the communicator 36 to be conveyed by the upper conveyor 33 and are then guided to the sheet reverse refeed route RR1 by the switching unit 56 of the main body side sheet discharger 34. In this description, a side subjected to the printing first in the duplex printing is referred to as front side and a side subjected printing later is referred to as back side. The sheets P guided to the sheet reverse refeed route RR1 are guided to the reverse rollers 61 by the switching gate 63 and are switched back by the reverse rollers 61 in the reverser 35. Then, the sheets P are guided to the sheet refeed rollers 62 by the switching gate 63 and are conveyed to the printer 32 by the sheet refeed rollers 62. In the printer 32, the sheets P are conveyed to the belt platen portion 47 by the registration rollers 46. In this case, the sheets P are turned upside down (backside front) by the switch back and the back sides not subjected to printing face the inkjet head portion 48. The sheets P are subjected to printing on the back sides with the ink ejected from the inkjet head portion 48 while being conveyed by the belt platen portion 47.

As in the case of the simplex printing described above, the sheets P subjected to printing on both sides are conveyed by the communication rollers 67, the introduction rollers 86, the upward conveyance rollers 87, and the sheet discharge rollers 88 to be discharged to the large-capacity sheet discharge tray 73.

When the sheets P subjected to printing on both sides are to be discharged to the large-capacity sheet discharge tray 73 with the back sides facing downward, as in the aforementioned case of discharging the sheets P subjected to the simplex printing with the print sides facing downward, the sheets P are turned upside down in the sheet discharge reverser 72 and are discharged to the large-capacity sheet discharge tray 73.

In the aforementioned print operation, the controller performs control of lowering the large-capacity sheet discharge tray 73 such that the top surface position of the sheets P stacked on the large-capacity sheet discharge tray 73 is maintained at the specified height position.

Specifically, when the top surface detection sensor 79 turns on, the controller 6 lowers the large-capacity sheet discharge tray 73 until the top surface detection sensor 79 turns off.

Moreover, in the aforementioned print operation, the controller 6 performs control of lifting the external sheet feed tray 11 being the sheet feed source such that the top surface position of the sheets P on the external sheet feed tray 11 is maintained at the sheet feed position. Specifically, when the upper limit sensor 14 for the external sheet feed tray 11 being the sheet feed source turns off due to feeding of the sheets P, the controller 6 lifts the external sheet feed tray 11 until the upper limit sensor 14 turns ON.

Moreover, when the external sheet feed tray 11 being the sheet feed source runs out of the sheets P in the aforementioned print operation, the controller 6 switches the sheet feed source to the other external sheet feed tray 11. This processing of switching the external sheet feed tray 11 is described with reference to the flowchart of FIG. 4. The processing of the flowchart of FIG. 4 starts with the start of the aforementioned print operation.

Figure 4:
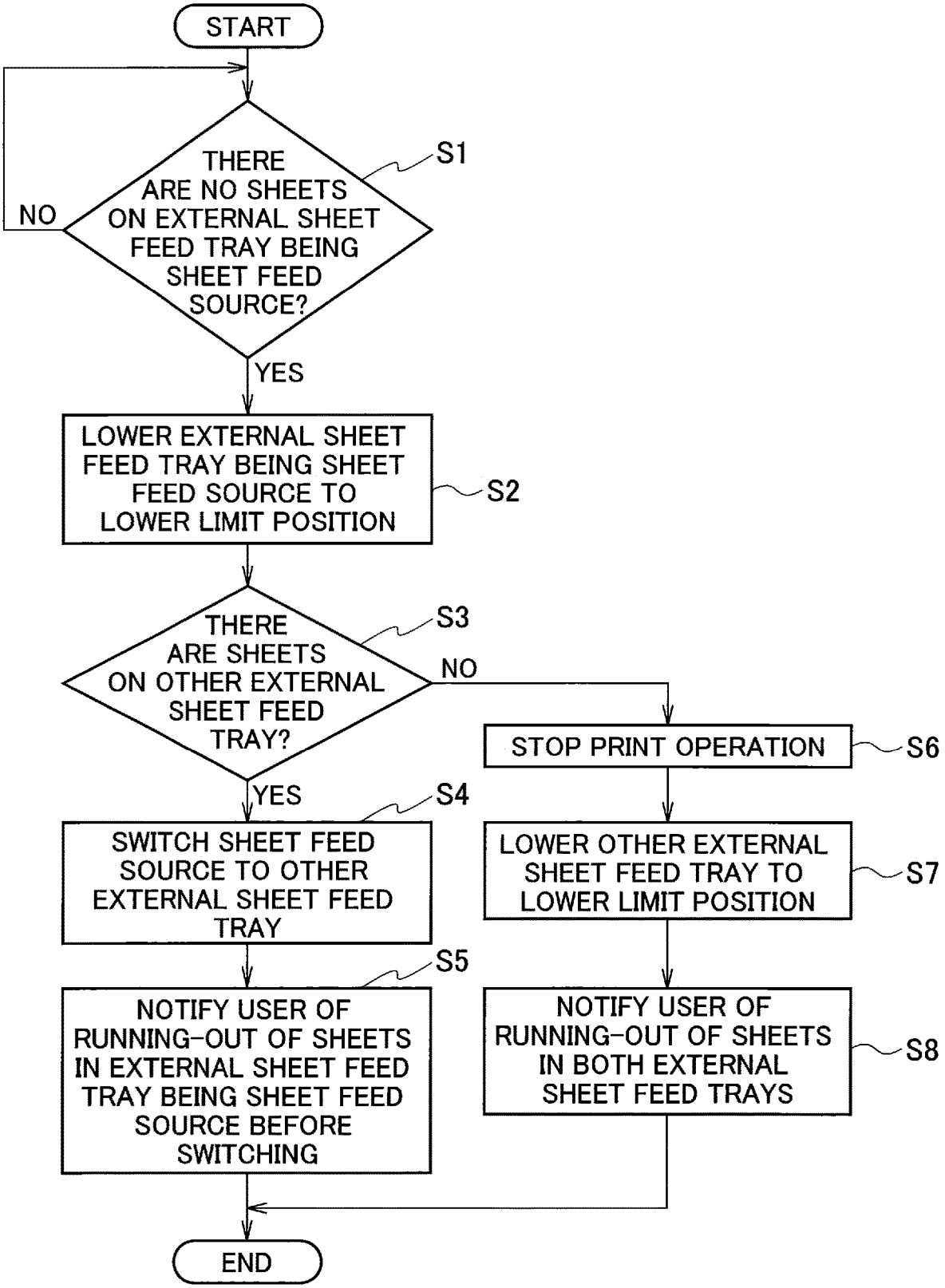
FIG. 4 is a flowchart of processing of switching an external sheet feed tray.

In step S1 of FIG. 4, the controller 6 determines whether there are no sheets P on the external sheet feed tray 11 being the current sheet feed source. When the sheet presence-absence sensor 15 for the external sheet feed tray 11 being the sheet feed source turns off, the controller 6 determines that there are no sheets P on the external sheet feed tray 11. When the controller 6 determines that there are sheets P on the external sheet feed tray 11 being the sheet feed source (step S1: NO) the controller 6 repeats step S1.

When the controller 6 determines that there are no sheets P on the external sheet feed tray 11 being the sheet feed source (step S1: YES), in step S2, the controller 6 lowers the external sheet feed tray 11 being the sheet feed source to the lower limit position. The controller 6 can determine whether the external sheet feed tray 11 being the sheet feed source reaches the lower limit position based on the states of detection of the detection target plate 11*a* in the respective remaining amount sensors 26 in the remaining amount detector 16 for this external sheet feed tray 11.

In this case, sheet feeding from the external sheet feeder 2 to the printer 32 is stopped due to running-out of the sheets P on the external sheet feed tray 11 being the sheet feed source.

Next, in step S3, the controller 6 determines whether there are sheets P on the other external sheet feed tray 11 based on the detection state of the sheet presence-absence sensor 15 for the other external sheet feed tray 11.

When the controller 6 determines that there are sheets P on the other external sheet feed tray 11 (step S3, YES), in step S4, the controller 6 switches the sheet feed source to the other external sheet feed tray 11. The sheet feeding is resumed from the external sheet feed tray 11 being the new sheet feed source and the print operation is continued.

Next, in step S5, the controller 6 notifies the user of the running-out of sheets P in the external sheet feed tray being the sheet feed source before the switching.

Specifically, the controller 6 turns on the notification lamp 37 and displays, on the display unit of the operation panel 38, that the external sheet feed tray 11 being the sheet feed source before the switching has run out of the sheets P and the sheets P need to be supplied. The series of processes is thereby completed.

In step S3, when the controller 6 determines that there are no sheets P on the other external sheet feed tray 11 (step S3: NO), in step S6, the controller 6 stops the print operation.

Then, in step S7, the controller 6 lowers the other external sheet feed tray 11 to the lower limit position.

Next, in step S8, the controller 6 notifies the user of the running-out of sheets P in both of the external sheet feed trays 11A, 11B. Specifically, the controller 6 turns on the notification lamp 37 and displays, on the display unit of the operation panel 38, that both of the external sheet feed trays 11A, 11B have run out of the sheets P. The series of processes is thereby completed.

The user sets the sheets P in the external sheet feed tray 11 having run out of sheets. An operation of the external sheet feed tray 11 in the case where the sheets P are set in the external sheet feed tray 11 having run out of sheets is described with reference to the flowchart of FIG. 5.

Figure 5:
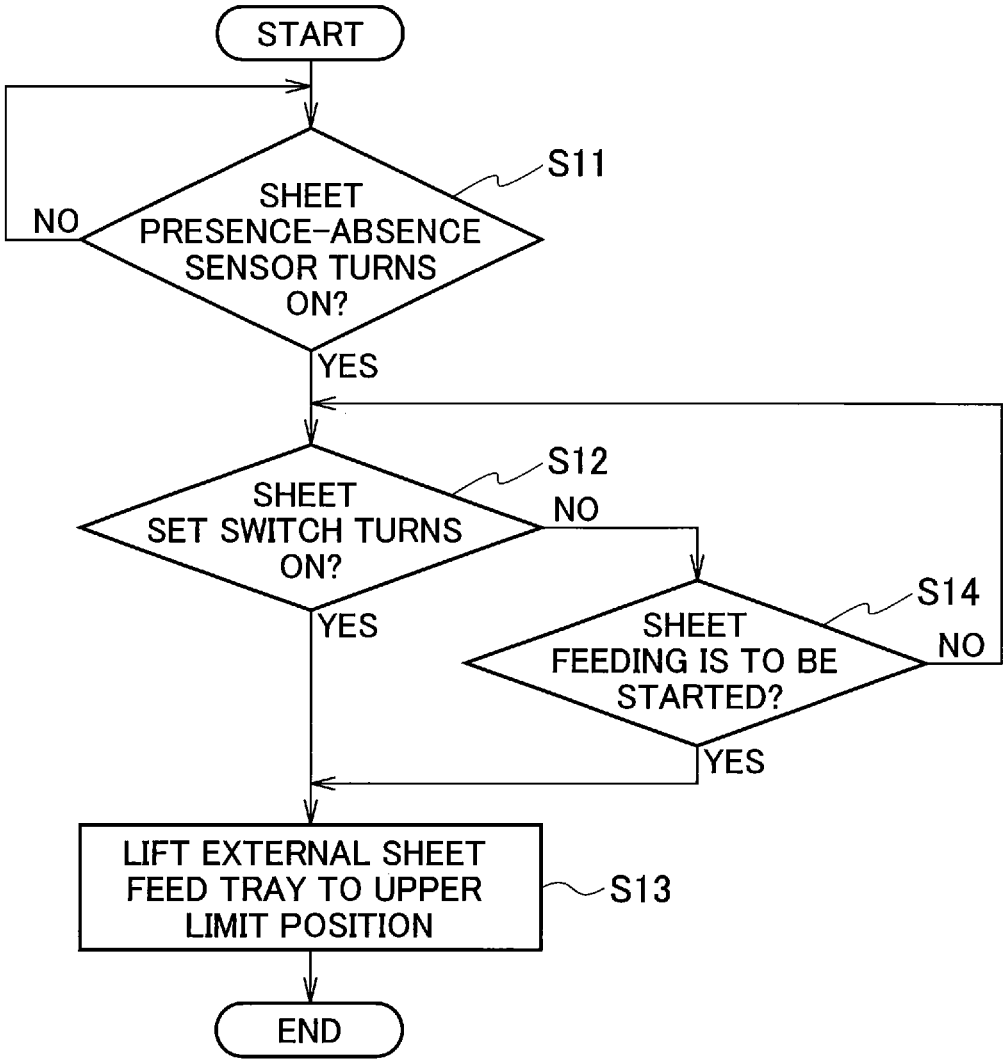
FIG. 5 is a flowchart for explaining operations of the external sheet feed tray in the case where sheets are set.

The processing of the flowchart of FIG. 5 starts when the sheet presence-absence sensor 15 for one of the external sheet feed trays 11A, 11B which is a processing target turns off. Here, the case where the external sheet feed tray 11A is the processing target is described. However, the processing of the flowchart of FIG. 5 is performed for each of the external sheet feed trays 11A, 11B.

In step S11 of FIG. 5, the controller 6 determines whether the sheet presence-absence sensor 15A for the external sheet feed tray 11A turns on from the off state. The sheet presence-absence sensor 15A turns on from the off state when the sheets P are set in the external sheet feed tray 11A having run out of sheets. When the controller 6 determines that the sheet presence-absence sensor 15A does not turn on (step S11: NO), the controller 6 repeats step S11.

When the controller 6 determines that the sheet presence-absence sensor 15A turns on (step S11: YES), in step S12, the controller 6 determines whether the sheet set switch 17A turns on. In this case, the sheet set switch 17A turns on when the user sets the sheets P in the external sheet feed tray 11A and performs operation of turning on the sheet set switch 17A.

When the controller 6 determines that the sheet set switch 17A turns on (step S12: YES), in step S13, the controller 6 lifts the external sheet feed tray 11A to the upper limit position. Specifically, the controller 6 lifts the external sheet feed tray 11A and stops the lifting of the external sheet feed tray 11A when the upper limit sensor turns on. A state where the sheet feeding from the external sheet feed tray 11A is possible is thereby achieved and the series of processes is completed.

When the controller 6 determines that the sheet set switch 17A is not on in step S12 (step S12: NO), in step S14, the controller 6 determines whether the sheet feeding from the external sheet feed tray 11A is to be started. In this case, for example, when the sheet feeding is to be resumed with the external sheet feed tray 11A set as the sheet feed source after the switching in the aforementioned switching processing of the external sheet feed tray 11, the controller 6 determines to start the sheet feeding from the external sheet feed tray 11A. When the controller 6 determines not to start the sheet feeding from the external sheet feed tray 11A (step S14: NO), the controller 6 returns to step S12.

When the controller 6 determines to start the sheet feeding from the external sheet feed tray 11A (step S14: YES), the controller 6 proceeds to step S13 and lifts the external sheet feed tray 11A to the upper limit position. A state where the sheet feeding from the external sheet feed tray 11A is possible is thereby achieved and the series of processes is completed.

Next, an unloading operation in which the conveyor 5 unloads the sheets P from the large-capacity sheet discharger 4 is described with reference to the flowchart of FIG. 6. The processing of the flowchart in FIG. 6 starts with the start of the aforementioned print operation.

Figure 6:
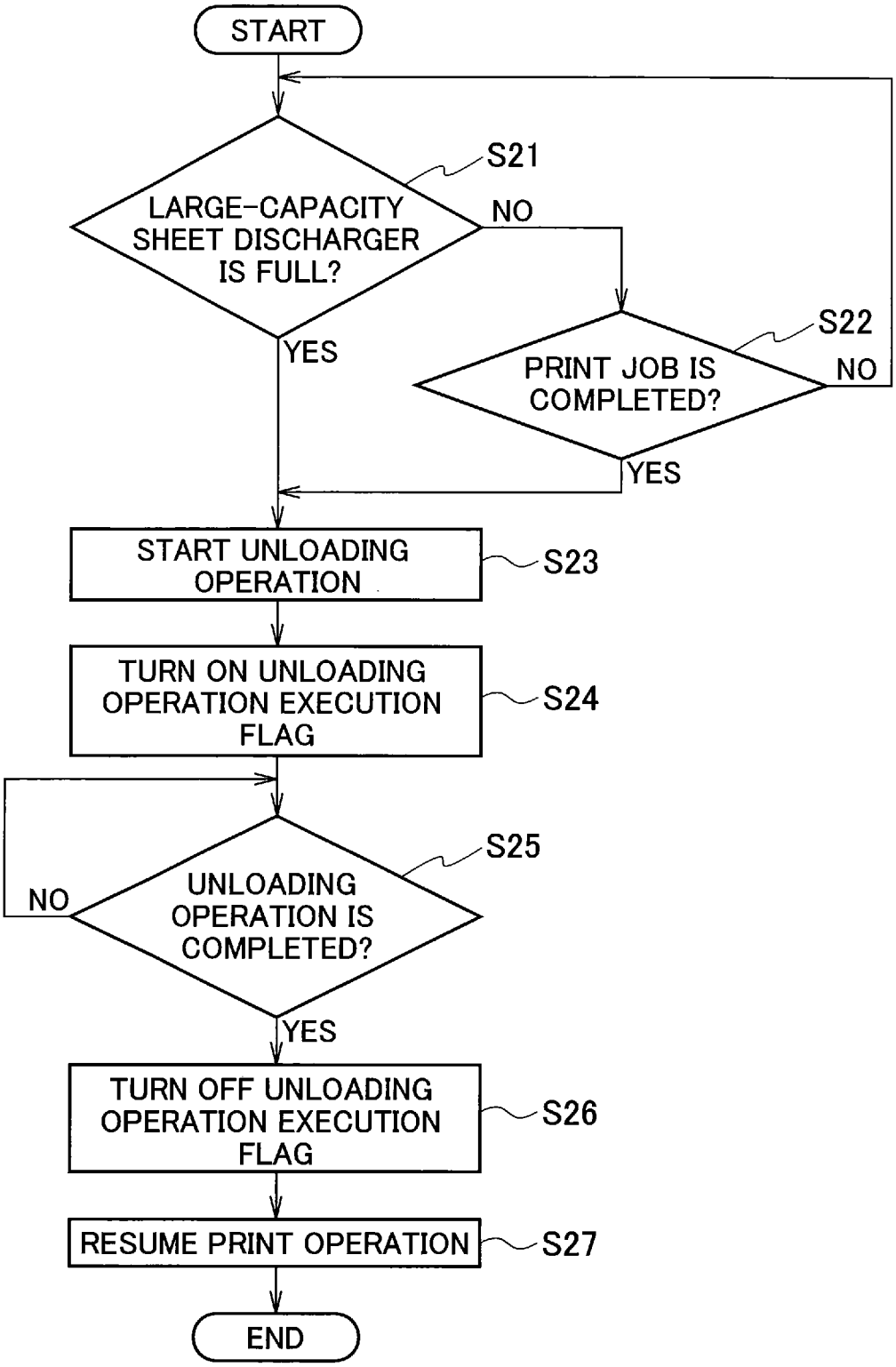
FIG. 6 is a flowchart for explaining an unloading operation by the unloader.

In step S21 of FIG. 6, the controller 6 determines whether the large-capacity sheet discharger 4 is full. In this case, the controller 6 determines that the large-capacity sheet discharger 4 is full when the full sensor 75 detects the large-capacity sheet discharge tray 73.

When the controller 6 determines that the large-capacity sheet discharger 4 is not full (step S21: NO), in step S22, the controller 6 determines whether the print job is completed. When the controller 6 determines that the print job is not completed (step S22: NO), the controller 6 returns to step S21.

When the controller 6 determines that the large-capacity sheet discharger 4 is full (step S21: YES) or that the print job is completed (step S22: YES), in step S23, the controller 6 starts the unloading operation by the conveyor 5.

Specifically, first, the controller 6 lowers the large-capacity sheet discharge tray 73 to the lower limit position when the large-capacity sheet discharger 4 is not full. Then, the controller 6 starts to rotate the drive roller 102 of the conveyor 5 clockwise in FIG. 3 with the large-capacity sheet discharge tray 73 located at the lower limit position. The belt 101 of the conveyor 5 thereby starts to rotate clockwise in FIG. 3. Along with this rotation, the controller 6 starts to rotate the drive roller 97 of the large-capacity sheet discharge tray 73 clockwise in FIG. 3. The belt 96 of the large-capacity sheet discharge tray 73 thereby starts to rotate clockwise in FIG. 3.

The sheets P on the large-capacity sheet discharge tray 73 thereby start to move to the right. When right end portions of the sheets P on the large-capacity sheet discharge tray 73 reach the conveyor 5, the sheets P are unloaded from the large-capacity sheet discharge tray 73 by the conveyor 5 while being sent out by the large-capacity sheet discharge tray 73.

When the large-capacity sheet discharger 4 becomes full or when the large-capacity sheet discharger 4 is not full but the print job is completed, the unloading operation by the conveyor 5 is started by the aforementioned processing in steps S21 to S23. When the unloading operation by the conveyor 5 is to be started, the controller 6 temporarily stops the sheet feeding to the printer 32 by the external sheet feeder 2. In other words, the controller 6 temporarily stops the print operation.

When the unloading operation by the conveyor 5 is started, in step S24, the controller 6 turns on an unloading operation execution flag. The unloading operation execution flag indicates whether the conveyor 5 is executing the unloading operation. The unloading operation execution flag is turned on when the conveyor 5 is performing the unloading operation.

Next, in step S25, the controller 6 determines whether the unloading operation by the conveyor 5 is completed. In this case, the controller 6 can determine the time (timing) at which the unloading from the large-capacity sheet discharge tray 73 to the conveyor 5 is completed based on the size of the sheets P discharged to the large-capacity sheet discharge tray 73. When the controller 6 determines that the unloading operation by the conveyor 5 is not completed (step S25: NO), the controller 6 repeats step S25.

When the controller 6 determines that the unloading operation by the conveyor 5 is completed (step S25: YES), in step S26, the controller 6 turns off the unloading operation execution flag.

Next, in step S27, the controller 6 resumes the print operation. The print operation (sheet feeding operation) is thereby continued with suspension due to the unloading operation by the conveyor 5 in the middle. However, when the unloading operation by the conveyor 5 is executed due to completion of the print job, the controller 6 does not resume the print operation unless the next print job is inputted.

The sheets P unloaded from the large-capacity sheet discharge tray 73 and stacked on the conveyor 5 by the unloading operation of the conveyor 5 are removed by the user.

Next, control of the external sheet feeder 2 performed in execution of the unloading operation by the conveyor 5 is described with reference to the flowchart of FIG. 7.

Figure 7:
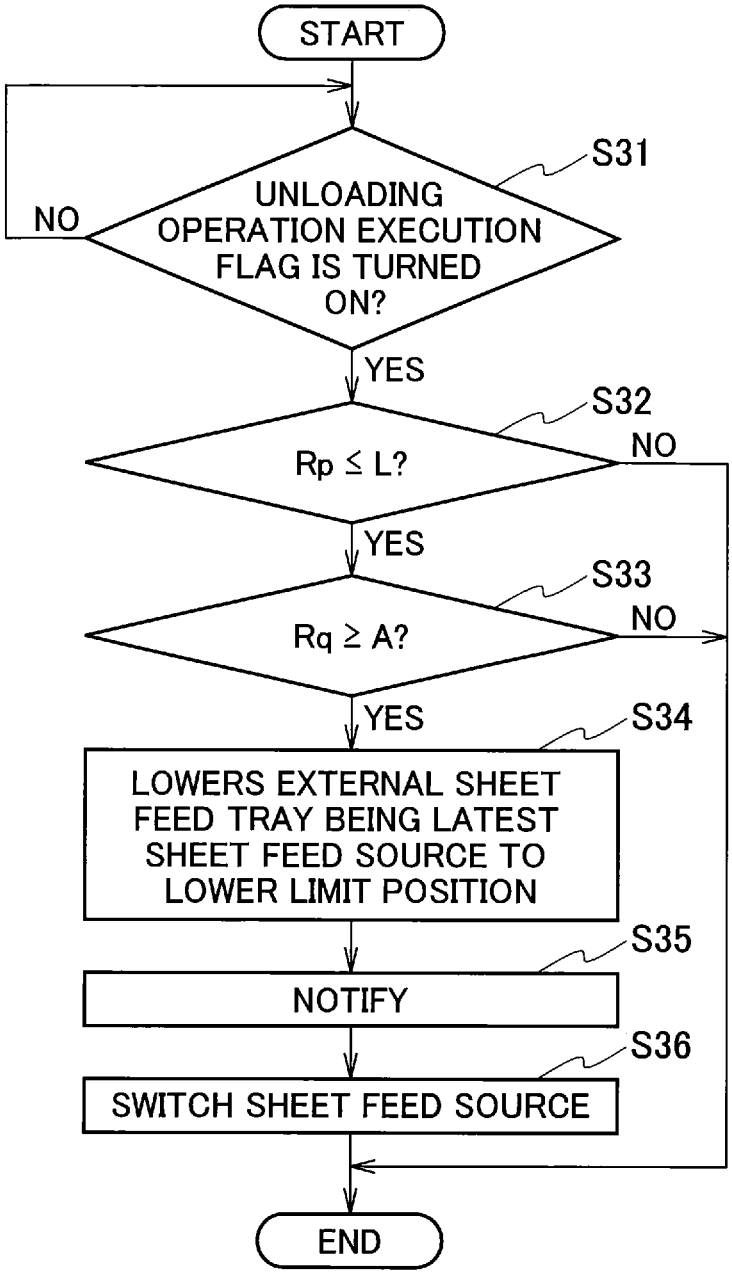
FIG. 7 is a flowchart of control of the external sheet feeder performed in execution of the unloading operation by the unloader in a first embodiment.

In step S31 of FIG. 7, the controller 6 determines whether the unloading operation execution flag is turned on. When the controller 6 determines that the unloading operation execution flag is not turned on (step S31: NO), the controller 6 repeats step S31.

When the controller 6 determines that the unloading operation execution flag is turned on (step S31: YES), in step S32, the controller 6 determines whether the sheet remaining amount Rp in the external sheet feed tray 11 being the latest sheet feed source is the supply reference value L or less. The external sheet feed tray 11 being the latest sheet feed source is one of the external sheet feed trays 11A, 11B which is used as the sheet feed source right up to the moment when the sheet feeding to the printer 32 by the external sheet feeder 2 is temporarily stopped due to the start of the unloading operation by the conveyor 5.

In this case, the remaining amount detector 16 is a detector which does not detect the exact number of sheets P remaining on the external sheet feed tray 11 but is a detector which can detect a certain range of the sheet remaining amount from the states of detection of the detection target plate 11*a* in the respective remaining amount sensors 26. Accordingly, the controller 6 determines the range of the sheet remaining amount including the sheet remaining amount Rp in the external sheet feed tray 11 being the latest sheet feed source, based on the states of detection of the detection target plate 11*a* in the respective remaining amount sensors 26 in the remaining amount detector 16 for the external sheet feed tray 11 being the latest sheet feed source. When the upper limit value of the range of the sheet remaining amount including the sheet remaining amount Rp is the supply reference value L or less, the controller 6 determines that Rp≤L.

When the controller 6 determines that Rp≤L (step S32: YES), in step S33, the controller 6 determines whether the sheet remaining amount Rq in the other external sheet feed tray 11 is equal or more than the sheet feed reference value A. Specifically, the controller 6 determines the range of the sheet remaining amount including the sheet remaining amount Rq in the other external sheet feed tray 11, based on the states of detection of the detection target plate 11*a* in the respective remaining amount sensors 26 of the remaining amount detector 16 for the other external sheet feed tray 11. When the lower limit value of the range of the sheet remaining amount including the sheet remaining amount Rq is the sheet feed reference value A or more, the controller 6 determines that Rq≥A.

When the controller 6 determines that Rq≥A (step S33: YES), in step S34, the controller 6 lowers the external sheet feed tray 11 being the latest sheet feed source to the lower limit position.

Next, in step S35, the controller 6 notifies the user that it is time to supply the sheets P to the external sheet feed tray 11. Specifically, the controller 6 turns on the notification lamp 37 and displays, on the display unit of the operation panel 38, a message prompting the user to supply the sheets P to one of the external sheet feed trays 11A, 11B which is the latest sheet feed source (which is lowered to the lower limit position). Moreover, in this case, the controller 6 displays, on the display unit, a message instructing the user to remove the sheets P unloaded from the large-capacity sheet discharge tray 73 and stacked on the conveyor 5, from the conveyor 5.

Next, in step S36, the controller 6 switches the sheet feed source from the external sheet feed tray 11 being the latest sheet feed source to the other external sheet feed tray 11. When the unloading operation by the conveyor 5 is completed and then the print operation is resumed, the sheets P are fed from the external sheet feed tray 11 being the new sheet feed source.

When the controller 6 determines that Rp>L in step S32 (step S32: NO) or when the controller 6 determines that Rq<A in step S33 (step S33: NO), the controller 6 terminates the series of control processes.

As described above, in the first embodiment, in the execution of the unloading operation by the conveyor 5, that is in the unloading of the sheets P from the large-capacity sheet discharger 4, the controller 6 determines whether to perform the switching of the external sheet feed tray 11 being the sheet feed source, based on the sheet remaining amount Rp in the external sheet feed tray 11 being the latest sheet feed source and the sheet remaining amount Rq in the other external sheet feed tray 11. When determining to perform the switching of the sheet feed source, the controller 6 controls the external sheet feeder 2 such that the sheet feed source is switched from the external sheet feed tray 11 being the latest sheet feed source to the other external sheet feed tray 11.

This allows the user to perform work of removing the discharged sheets P and supply the sheets P to the external sheet feed tray 11 with a small sheet remaining amount without stopping the print operation to supply the sheets P to the external sheet feed tray 11. As a result, it is possible to reduce occurrence of a situation where the print operation is stopped due to the running-out of sheets P in the external sheet feed tray 11 and the printing apparatus 1 waits to be supplied with the sheets P. Accordingly, a decrease in printed sheet productivity can be reduced.

Specifically, if the sheet remaining amount Rp in the external sheet feed tray 11 which is the latest sheet feed source is the supply reference value L or less and the sheet remaining amount Rq in the other external sheet feed tray 11 is the sheet feed reference value A or more in unloading of the sheets P from the large-capacity sheet discharger 4, the controller 6 determines to perform the switching of the sheet feed source from the external sheet feed tray 11 being the latest sheet feed source to the other external sheet feed tray 11. As a result, it is possible to properly determine whether to perform the switching of the sheet feed source for supply of sheets depending on the sheet remaining amounts of the respective external sheet feed trays 11. Accordingly, a frequency of supply of sheets can be decreased.

Moreover, when the sheet feed source is switched from the external sheet feed tray 11 being the latest sheet feed source to the other external sheet feed tray 11, the controller 6 lowers the external sheet feed tray 11 being the sheet feed source before the switching to the lower limit position. This facilitates the work of supplying the sheets P to the external sheet feed tray 11 being the sheet feed source before the switching.

Furthermore, when the sheet feed source is switched from the external sheet feed tray 11 being the latest sheet feed source to the other external sheet feed tray 11, the controller 6 controls the notification lamp 37 such that the notification lamp 37 notifies the user that it is time to supply the sheets P to the external sheet feed tray 11. This can reduce occurrence of the case where the user forgets supplying the sheets P to the external sheet feed tray 11. As a result, it is possible to further reduce occurrence of the situation where the print operation is stopped due to the running-out of sheets P in the external sheet feed tray 11 and the printing apparatus 1 waits to be supplied with the sheets P. Accordingly, the decrease in printed sheet productivity can be further reduced.

Moreover, since the printing apparatus 1 includes the conveyor 5, the unloading of the sheets P from large-capacity sheet discharger 4 can be automatically performed. Accordingly, the print operation can be continuously performed even when the large-capacity sheet discharger 4 becomes full.

Next, a second embodiment is described in which the control of the external sheet feeder 2 performed in the execution of the unloading operation by the conveyor 5 is changed from that in the first embodiment.

Figure 8:
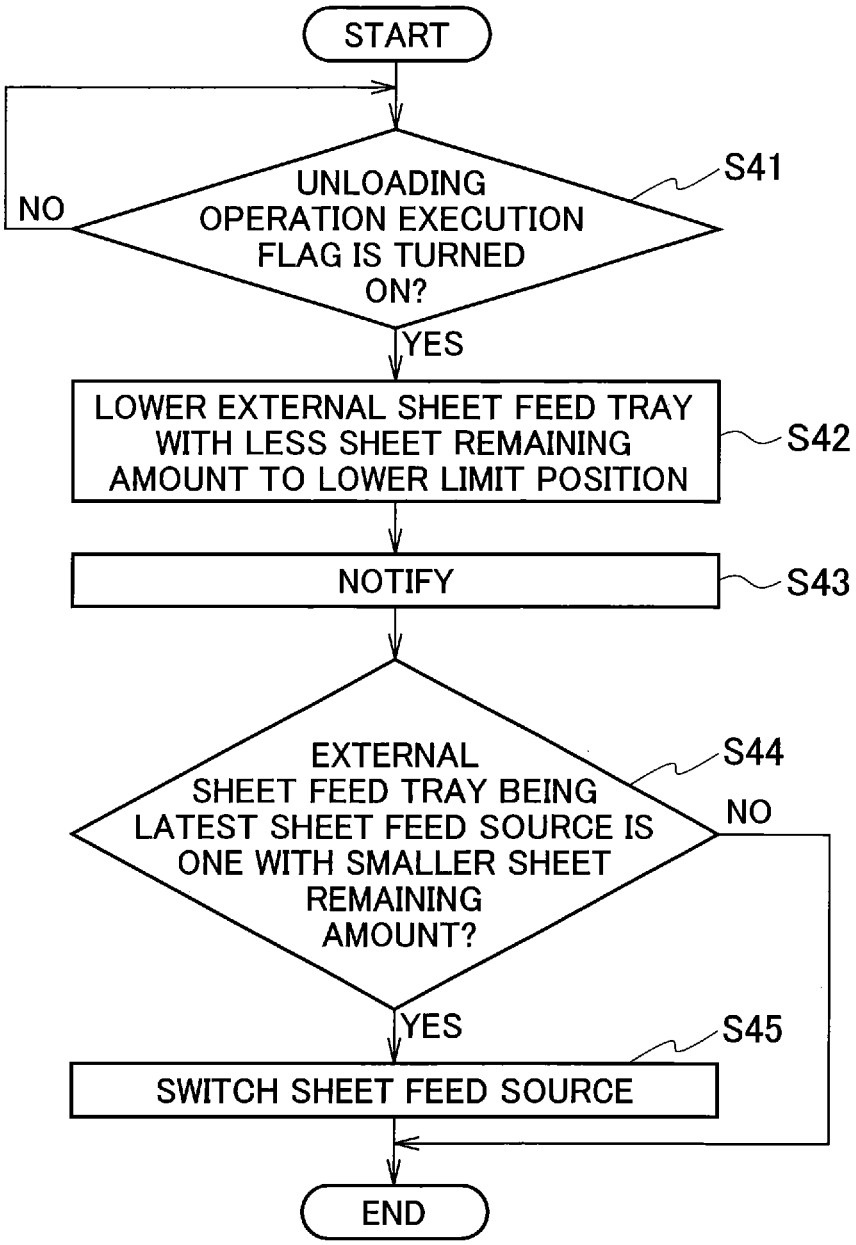
FIG. 8 is a flowchart of control of the external sheet feeder performed in the execution of the unloading operation by the unloader in a second embodiment.

FIG. 8 is a flowchart of the control of the external sheet feeder 2 performed in the execution of the unloading operation by the conveyor 5 in the second embodiment.

Processing of step S41 in FIG. 8 is the same as the processing of step S31 in FIG. 7 described in the first embodiment.

When the controller 6 determines that the unloading operation execution flag is turned on in step S41 (step S41: YES), in step S42, the controller 6 lowers one of the external sheet feed trays 11A, 11B with the smaller sheet remaining amount to the lower limit position. Note that, when the sheet remaining amounts of the external sheet feed trays 11A, 11B are included in the same range among ranges of the sheet remaining amounts detectable by the remaining amount detectors 16, the controller 6 may assume either of the external sheet feed trays 11 as the external sheet feed tray 11 with the smaller sheet remaining amount and lower this external sheet feed tray 11.

Next, in step S43, the controller 6 notifies the user that it is time to supply the sheets P to the external sheet feed tray 11. Specifically, the controller 6 turns on the notification lamp 37 and displays, on the display unit of the operation panel 38, a message prompting the user to supply the sheets P to one of the external sheet feed trays 11A, 11B lowered to the lower limit position. Moreover, in this case, the controller 6 displays, on the display unit, a message instructing the user to remove the sheets P unloaded from the large-capacity sheet discharge tray 73 and stacked on the conveyor 5, from the conveyor 5.

Next, in step S44, the controller 6 determines whether the external sheet feed tray 11 being the latest sheet feed source is the external sheet feed tray 11 with the smaller sheet remaining amount. In other words, the controller 6 determines whether the external sheet feed tray 11 being the latest sheet feed source is the external sheet feed tray 11 lowered to the lower limit position in step S42.

When the controller 6 determines that the external sheet feed tray 11 being the latest sheet feed source is the external sheet feed tray 11 with the smaller sheet remaining amount (step S44: YES), in step S45, the controller 6 switches the sheet feed source from the external sheet feed tray 11 being the latest sheet feed source to the other external sheet feed tray 11. When the unloading operation by the conveyor 5 is completed and then the print operation is resumed, the sheets P are fed from the external sheet feed tray 11 being the new sheet feed source.

When the controller 6 determines that the external sheet feed tray 11 being the latest sheet feed source is the external sheet feed tray 11 with the larger sheet remaining amount (step S44: NO), the controller 6 terminates the series of control processes.

As described above, in the second embodiment, in the execution of the unloading operation by the conveyor 5, that is in the unloading of the sheets P from the large-capacity sheet discharger 4, if the external sheet feed tray 11 being the latest sheet feed source is the external sheet feed tray 11 with the smaller sheet remaining amount, the controller 6 determines to perform the switching of the sheet feed source from the external sheet feed tray 11 being the latest sheet feed source to the other external sheet feed tray 11.

The controller 6 determines whether the external sheet feed tray 11 being the latest sheet feed source is the external sheet feed tray 11 with the smaller sheet remaining amount and, based on the determination, determines whether to perform the switching of the sheet feed source. That is, the controller 6 determines whether to perform the switching of the sheet feed source based on the sheet remaining amount Rp in the external sheet feed tray 11 being the latest sheet feed source and the sheet remaining amount Rq in the other external sheet feed tray 11. When determining to perform the switching, the controller 6 controls the external sheet feeder 2 such that the sheet feed source is switched from the external sheet feed tray 11 being the latest sheet feed source to the other external sheet feed tray 11.

This allows the user to perform work of removing the discharged sheets P and supply the sheets P to the external sheet feed tray 11 without stopping the print operation to supply the sheets P to the external sheet feed tray 11 in the second embodiment, as in the first embodiment. As a result, it is possible to reduce the occurrence of the situation where the print operation is stopped due to the running-out of sheets P in the external sheet feed tray 11 and the printing apparatus 1 waits to be supplied with the sheets P. Accordingly, the decrease in printed sheet productivity can be further reduced.

The controller 6 determines to perform the switching of the sheet feed source when the external sheet feed tray 11 being the latest sheet feed source is the external sheet feed tray 11 with the smaller sheet remaining amount in the unloading of the sheets P from the large-capacity sheet discharger 4. This allows the user to supply the sheets P to the external sheet feed tray 11 with the smaller sheet remaining amount at every performance of work of removing the discharged sheets P. Accordingly, a frequency of occurrence of running-out of sheets P can be decreased.

Moreover, in the unloading of the sheets P from the large-capacity sheet discharger 4, the controller 6 lowers the external sheet feed tray 11 with the smaller sheet remaining amount to the lower limit position. This facilitates the work of supplying the sheets P to the external sheet feed tray 11 with the smaller sheet remaining amount.

Furthermore, in the unloading of the sheets P from the large-capacity sheet discharger 4, the controller 6 controls the notification lamp 37 such that the notification lamp 37 notifies the user that it is time to supply the sheets P to the external sheet feed tray 11. This can reduce occurrence of the case where the user forgets supplying the sheets P to the external sheet feed tray 11. As a result, it is possible to further reduce occurrence of the situation where the print operation is stopped due to the running-out of sheets P in the external sheet feed tray 11 and the printing apparatus 1 waits to be supplied with the sheets P. Accordingly, the decrease in printed sheet productivity can be further reduced.

Figure 10:
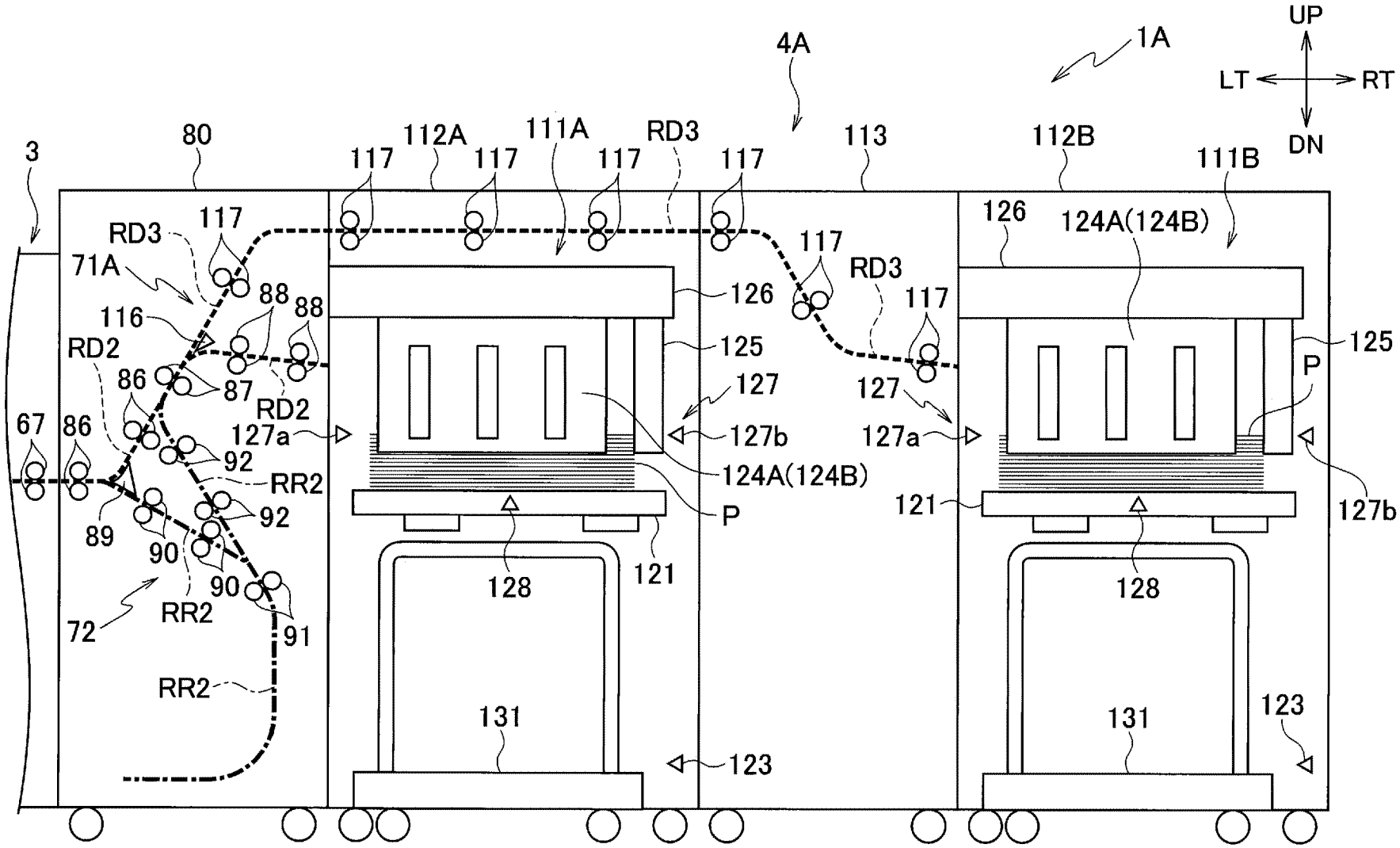
FIG. 10 is a schematic configuration diagram of a large-capacity sheet discharger in the printing apparatus illustrated in FIG. 9.

Next, a third embodiment is described in which part of the printing apparatus of the first embodiment is changed. In FIG. 10, the directions of right, left, up, and down are denoted by RT, LT, UP, and DN, respectively.

Figure 9:
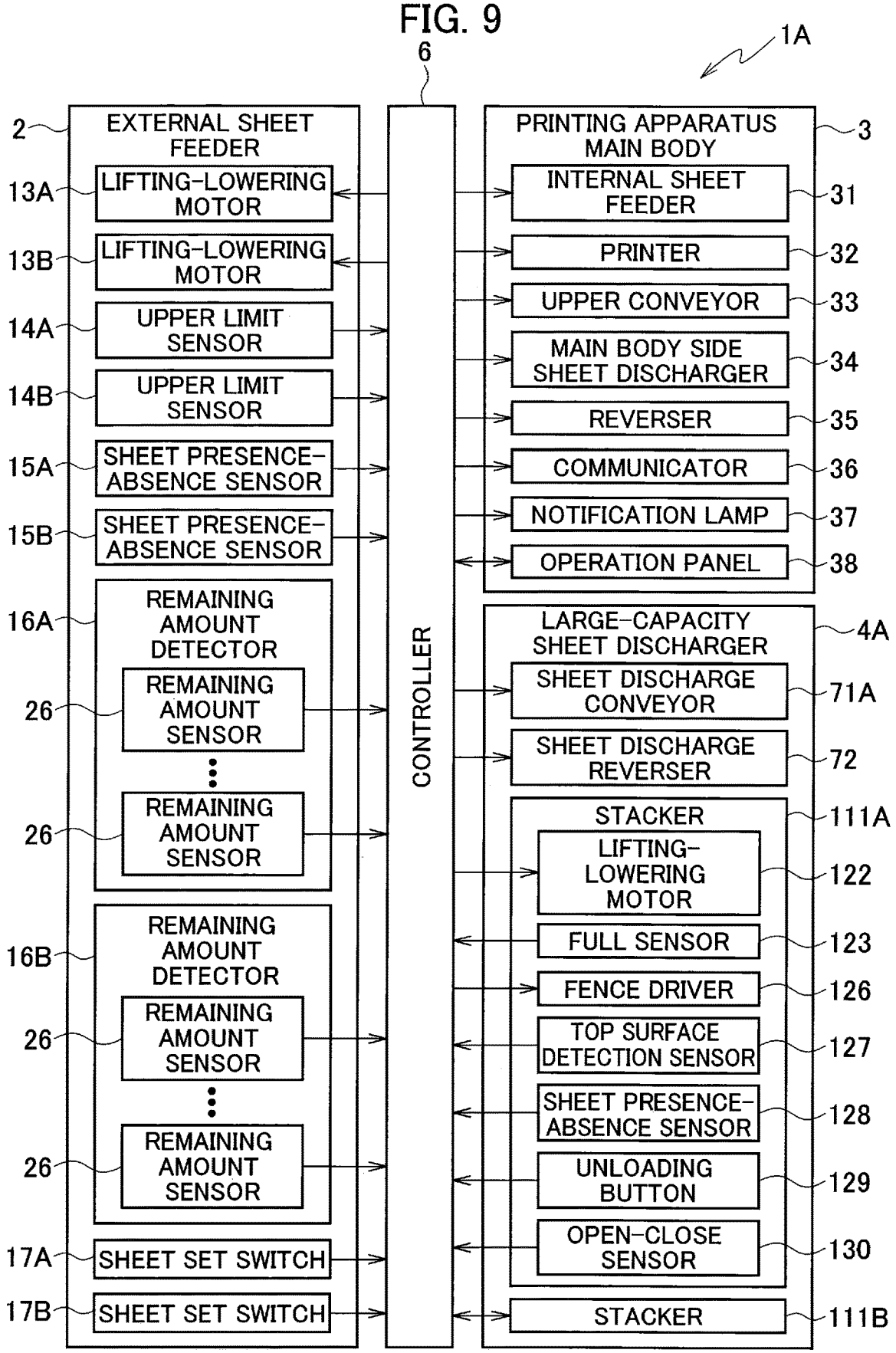
FIG. 9 is a block diagram illustrating a configuration of a printing apparatus according to a third embodiment.

FIG. 9 is a block diagram illustrating a configuration of a printing apparatus according to the third embodiment. FIG. 10 is a schematic configuration diagram of a large-capacity sheet discharger in the printing apparatus illustrated in FIG. 9.

As illustrated in FIGS. 9 and 10, the printing apparatus LA according to the third embodiment has a configuration in which the large-capacity sheet discharger 4 in the printing apparatus 1 of the first embodiment is replaced by a large-capacity sheet discharger 4A and the conveyor 5 is omitted. In the printing apparatus LA, the user performs work of unloading the sheets P from the large-capacity sheet discharger 4A.

The large-capacity sheet discharger 4A includes a sheet discharge conveyor 71A, a sheet discharge reverser 72, stackers 111A, 111B, a sheet discharge conveyance side case 80 housing part of the sheet discharge conveyor 71A and the like, stacker cases 112A, 112B housing the stackers 111A, 111B, respectively, and an intermediate case 113 housing a portion of the sheet discharge conveyor 71A between the stackers 111A, 111B.

The sheet discharge conveyor 71A has a configuration in which a switching unit 116 and multiple pairs of downstream sheet discharge conveyance rollers 117 are added to the sheet discharge conveyor 71 of the first embodiment.

The switching unit 116 switches the conveyance route of the sheets P between a downstream portion of the large-capacity sheet discharge route RD2 and a large-capacity downstream sheet discharge route RD3. The large-capacity downstream sheet discharge route RD3 is a route branching from the large-capacity sheet discharge route RD2 at a position between the pair of upward conveyance rollers 87 and the upstream pair of the sheet discharge rollers 88 and extending toward the downstream stacker 111B. The switching unit 116 is arranged at the point where the large-capacity downstream sheet discharge route RD3 branches from the large-capacity sheet discharge route RD2.

The downstream sheet discharge conveyance rollers 117 conveys and discharges the sheets P, guided to the large-capacity downstream sheet discharge route RD3 by the switching unit 116, to the downstream stacker 111B. The downstream sheet discharge conveyance rollers 117 are arranged between the switching unit 116 and the stacker 111B along the large-capacity downstream sheet discharge route RD3. The downstream sheet discharge conveyance rollers 117 are rotationally driven by a not-illustrated motor.

The sheet discharge reverser 72 of the large-capacity sheet discharger 4A is the same as the sheet discharge reverser 72 of the large-capacity sheet discharger 4 in the first embodiment.

The stackers 111 are portions where the sheets P subjected printing and discharged by the sheet discharge conveyor 71A are stacked and held. The sheets P discharged by the sheet discharge rollers 88 are stacked on the upstream stacker 111A. The sheets P discharged by the downstream sheet discharge conveyance rollers 117 are stacked on the downstream stacker 111B. Each stacker 111 includes a sheet discharge tray 121, a lifting-lowering motor 122, a full sensor 123, one pair of side fences 124A, 124B, an end fence 125, a fence driver 126, a top surface detection sensor 127, a sheet presence-absence sensor 128, an unloading button 129, an open-close sensor 130, and a wheeled platform 131.

The sheet discharge tray 121 is a tray on which the sheets P subjected to printing and discharged by the sheet discharge conveyor 71A are stacked. The sheet discharge tray 121 of the upstream stacker 111A is arranged below and downstream of the sheet discharge rollers 88. The sheet discharge tray 121 of the downstream stacker 111B is arranged below and downstream of the most downstream pair of downstream sheet discharge conveyance rollers 117. Each sheet discharge tray 121 is configured to be capable of being lifted and lowered such that the larger the number of the stacked sheets P is, the more the sheet discharge tray 121 is lowered. Many sheets P can be stacked on the sheet discharge tray 121. The sheet discharge tray 121 of the stacker 111A and the sheet discharge tray 121 of the stacker 111B are selectively used as the sheet discharge destination of the sheets P subjected to printing in the printer 32.

The lifting-lowering motor 122 lowers and lifts the sheet discharge tray 121.

The full sensor 123 detects that the sheet discharge tray 121 is full of the sheets P. Specifically, the full sensor 123 detects the sheet discharge tray 121 at a lower limit position which is a height position in the case where the maximum stackable number of sheets P are stacked on the sheet discharge tray 121.

The side fences 124A, 124B, the end fence 125, and the fence driver 126 are the same as the side fences 76A, 76B, the end fence 77, and the fence driver 78 of the large-capacity sheet discharger 4 in the first embodiment, respectively.

The top surface detection sensor 127 is the same as the top surface detection sensor 79 of the large-capacity sheet discharger 4 in the first embodiment and includes a light emitter 127*a* and a light receiver 127*b* which are the same as the light emitter 79*a* and the light receiver 79*b* of the top surface detection sensor 79.

The sheet presence-absence sensor 128 detects presence or absence of the sheets P on the sheet discharge tray 121. In this case, a state where the sheet presence-absence sensor 128 detects that there are sheets P on the sheet discharge tray 121 is referred to as on and a state where the sheet presence-absence sensor 128 does not detect that there are sheets P on the sheet discharge tray 121 is referred to as off.

The unloading button 129 is a button to be pressed when the user performs work of unloading the sheets P from the stacker 111. When the unloading button 129 is pressed, the sheet discharge tray 121 is placed on the wheeled platform 131.

The open-close sensor 130 detects whether a door (not illustrated) in the stacker case 112 is opened or closed. The door in the stacker case 112 is opened when the user unloads the sheets P from the stacker 111.

The wheeled platform 131 is used by the user to pull out the sheet discharge tray 121 on which the sheets P are stacked from the stacker case 112 in work of unloading the sheets P from the stacker 111.

Next, description is given of a print operation of the printing apparatus 1A in the case of executing a print job in which the sheets P are fed from the external sheet feeder 2 and discharged to the large-capacity sheet discharger 4A. In this print operation, it is assumed that the sheets P of the same type and the same size are stacked on the external sheet feed trays 11A, 11B of the external sheet feeder 2.

The sheet feeding operation of the external sheet feeder 2 and the print operation of the printing apparatus main body 3 are the same as the corresponding operations in the printing apparatus 1 described in the first embodiment.

The sheets P subjected to the printing are discharged to the sheet discharge tray 121 in one of the stackers 111A, 111B in the large-capacity sheet discharger 4A.

When the sheet discharge destination is the sheet discharge tray 121 in the stacker 111A, the sheets P are guided from the upward conveyance rollers 87 to the sheet discharge rollers 88 by the switching unit 116 and discharged to the sheet discharge tray 121 in the stacker 111A by the sheet discharge rollers 88.

When the sheet discharge destination is the sheet discharge tray 121 in the stacker 111B, the sheets P are guided from the upward conveyance rollers 87 to the downstream sheet discharge conveyance rollers 117 by the switching unit 116. Then, the sheets P are conveyed along the large-capacity downstream sheet discharge route RD3 by the downstream sheet discharge conveyance rollers 117 and discharged to the sheet discharge tray 121 in the stacker 111B.

In the aforementioned print operation, the controller 6 performs control of lowering the sheet discharge tray 121 such that the top surface position of the sheets P stacked on the sheet discharge tray 121 of the stacker 111 being the sheet discharge destination is maintained at the specified height position. Specifically, when the top surface detection sensor 127 of the stacker 111 being the sheet discharge destination turns on, the controller 6 lowers the sheet discharge tray 121 until the top surface detection sensor 127 turns off.

Moreover, in the aforementioned print operation, the controller 6 performs control of lifting the external sheet feed tray 11 such that the top surface position of the sheets P on the external sheet feed tray 11 being the sheet feed source is maintained at the sheet feed position as in the first embodiment.

Processing of switching the external sheet feed tray 11 in the case were the external sheet feed tray 11 being the sheet feed source runs out of sheets P is the same as that in the first embodiment and is performed in the steps in the flowchart of FIG. 4.

Moreover, an operation of the external sheet feed tray 11 in the case where the sheets P are set in the external sheet feed tray 11 having run out of sheets is the same as that in the first embodiment and is performed in the steps in the flowchart of FIG. 5.

Next, an operation in the case where the sheet discharge destination of the sheets P is changed during the aforementioned print operation is described with reference to the flowchart of FIG. 11. The processing of the flowchart of FIG. 11 starts with the start of the aforementioned print operation.

Figure 11:
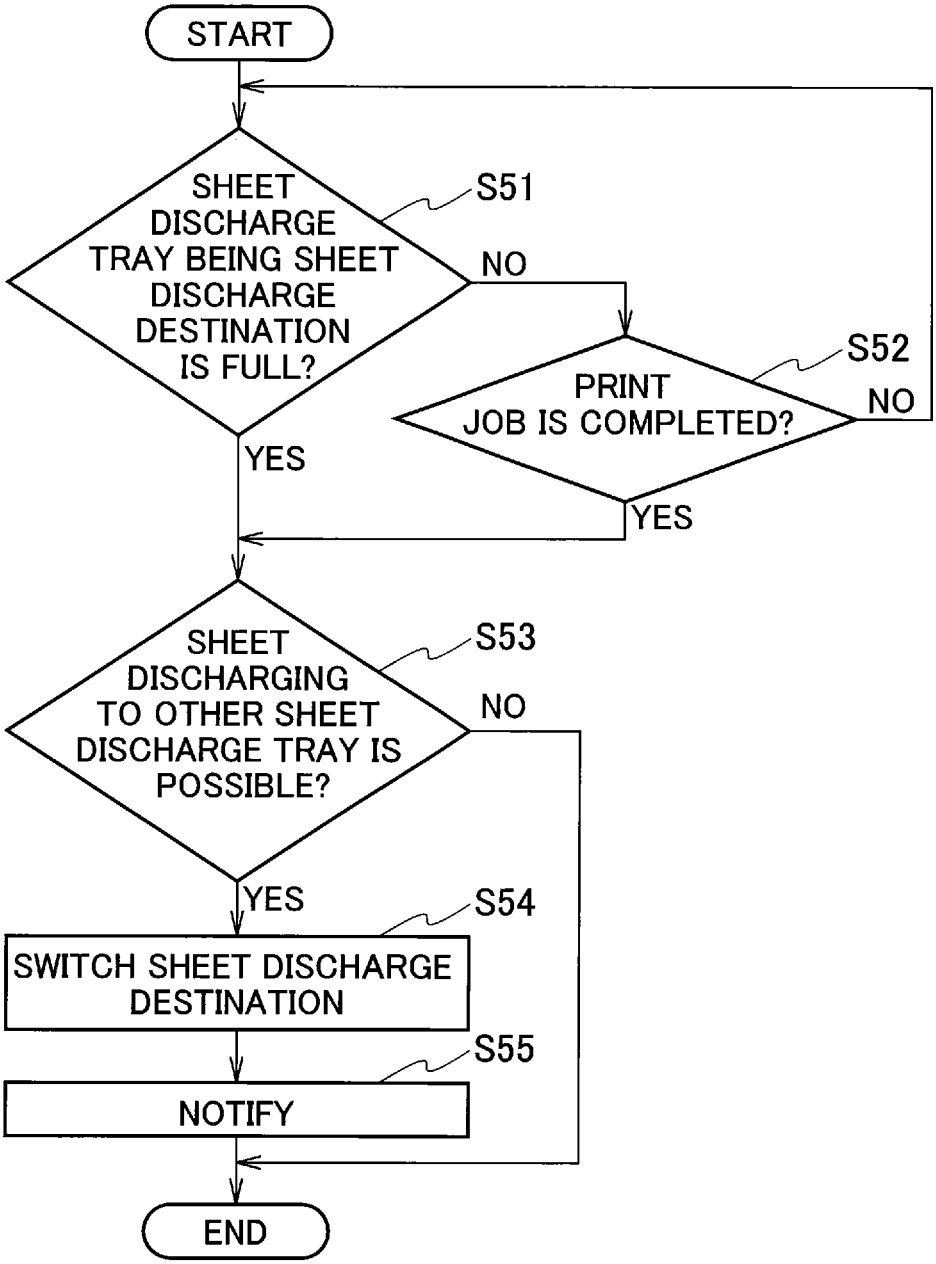
FIG. 11 is a flowchart for explaining an operation in switching of a discharge destination of the sheets.

In step S51 of FIG. 11, the controller 6 determines whether the sheet discharge tray 121 being the current sheet discharge destination is full. When the full sensor 123 for the sheet discharge tray 121 being the current sheet discharge destination detects the sheet discharge tray 121 in this case, the controller 6 determines that this sheet discharge tray 121 is full.

When the controller 6 determines that the sheet discharge tray 121 being the sheet discharge destination is not full (step S51: NO), in step S52, the controller 6 determines whether the print job is completed. When the controller 6 determines that the print job is not completed (step S52: NO), the controller 6 returns to step S51.

When the controller 6 determines that the sheet discharge tray 121 being the sheet discharge destination is full (step S51: YES) or that the print job is completed (step S52: YES), in step S53, the controller 6 determines whether the sheet discharging to the other sheet discharge tray 121 is possible.

In this case, when there are no sheets P on the other sheet discharge tray 121, the controller 6 determines that the sheet discharging to the other sheet discharge tray 121 is possible. Note that, even if there are sheets P on the other sheet discharge tray 121, the controller 6 may determine that the sheet discharging is possible as long as the other sheet discharge tray 121 is not full.

When the controller 6 determines that the sheet discharging to the other sheet discharge tray 121 is possible (step S53: YES), in step S54, the controller 6 controls the switching unit 116 to switch the sheet discharge tray 121 being the sheet discharge destination.

Next, in step S55, the controller 6 notifies the user that unloading of the sheets P from the large-capacity sheet discharger 4A is possible. Specifically, the controller 6 displays, on the display unit of the operation panel 38, a message indicating that the unloading of the sheets P from the large-capacity sheet discharger 4A is possible. The series of processes is thereby completed. Note that the configuration may be such that a lamp configured to notify the user that the unloading of the sheets P from the large-capacity sheet discharger 4A is possible is installed in each stacker case 112 and this lamp is turned on to notify the user that the unloading of the sheets P is possible.

When the controller 6 determines that the sheet discharging to the other sheet discharge tray 121 is not possible (step S53: NO), the controller 6 terminates the series of processes. In this case, since the sheet discharging cannot be performed, the print operation is stopped.

When the user is notified that the unloading of the sheets P from the large-capacity sheet discharger 4A is possible, the user performs work of unloading the sheets P from the large-capacity sheet discharger 4A. An operation of the printing apparatus 1A in this unloading of the sheets P is described with reference to the flowchart of FIG. 12. The processing of the flowchart of FIG. 12 starts in response to the switching of the sheet discharge destination.

Figure 12:
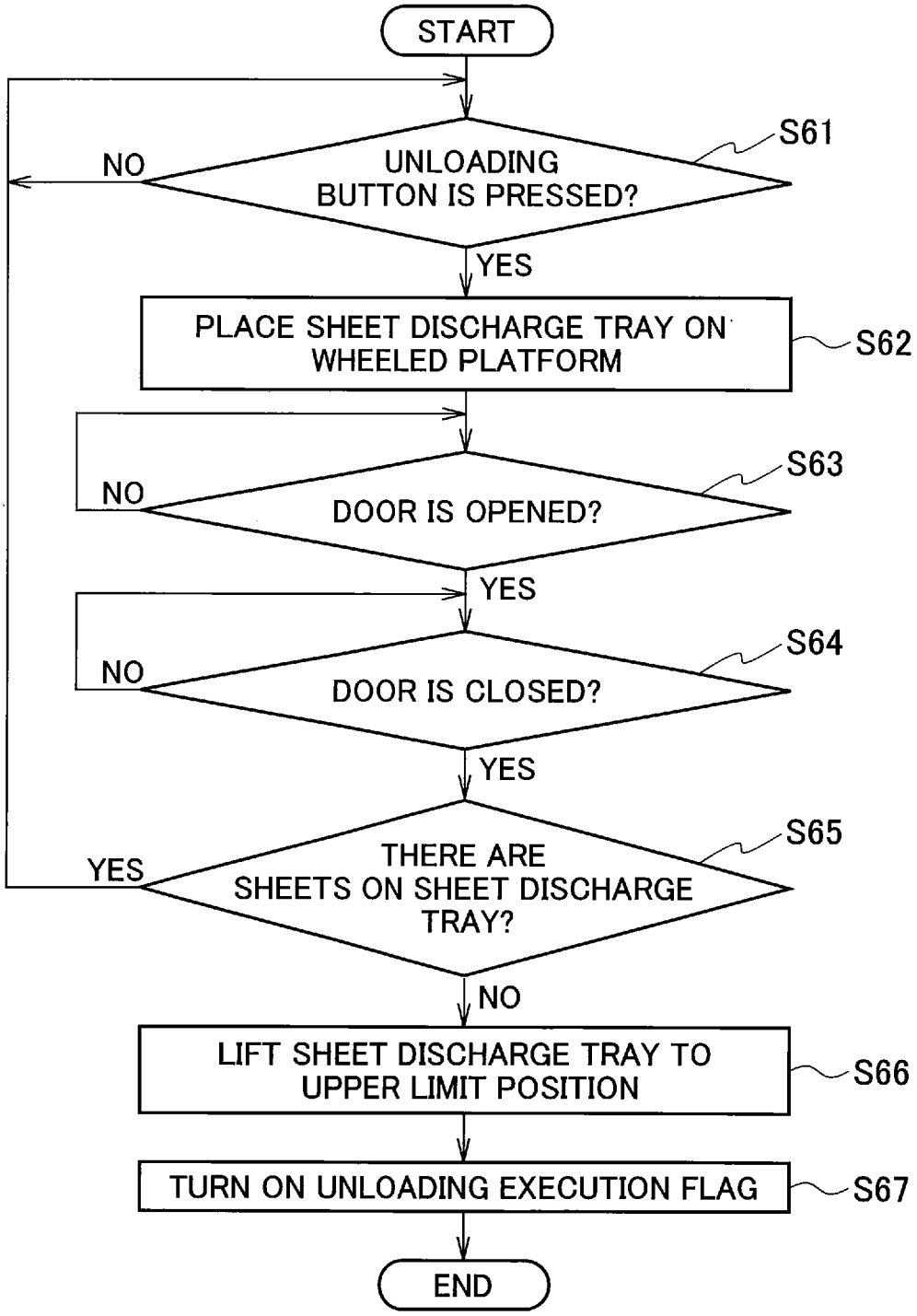
FIG. 12 is a flowchart for explaining an operation of the printing apparatus in unloading of the sheets.

In step S61 of FIG. 12, the controller 6 determines whether the unloading button 129 of the stacker 111 being the sheet discharge destination before the switching (stacker 111 not being the current sheet discharge destination) is pressed or not. When the controller 6 determines the unloading button 129 is not pressed (step S61: NO), the controller 6 repeats step S61.

When the controller 6 determines that the unloading button 129 is pressed (step S61: YES), in step S62, the controller 6 lowers the sheet discharge tray 121 of the stacker 111 not being the current sheet discharge destination to place the sheet discharge tray 121 on the wheeled platform 131. Lowering the sheet discharge tray 121 beyond the lower limit position in this case allows the sheet discharge tray 121 to be placed on the wheeled platform 131.

Next, in step S63, the controller 6 determines whether the door of the stacker case 112 of the stacker 111 not being the current sheet discharge destination is opened based on an output signal of the open-close sensor 130 of this stacker 111. When the controller 6 determines that the door is not opened (step S63: NO), the controller 6 repeats step S63.

When the controller 6 determines that the door is opened (step S63: YES), in step S64, the controller 6 determines whether the opened door is closed based on the output signal of the open-close sensor 130. When the controller 6 determines that the door is not closed (step S64: NO), the controller 6 repeats step S64.

When the controller 6 determines that the door is closed (step S64: YES), in step S65, the controller 6 determines whether there are sheets P on the sheet discharge tray 121 of the stacker 111 not being the current sheet discharge destination. When the sheet presence-absence sensor 128 of the stacker 111 not being the current sheet discharge destination is on, the controller 6 determines that there are sheets P on the sheet discharge tray 121 of this stacker 111.

In the work of unloading the sheets P from the stacker 111, the user presses the unloading button 129 and then opens the door of the stacker case 112. Next, the user pulls out the wheeled platform 131 on which the sheet discharge tray 121 is placed, from the stacker case 112 and removes the sheets P on the sheet discharge tray 121. Then, the user returns the wheeled platform 131 on which the sheet discharge tray 121 without sheets P is placed, into the stacker case 112 and closes the door.

Accordingly, when there are no sheets P on the sheet discharge tray 121 in the stacker case 112 after the opening and closing of the door of the stacker case 112, the controller 6 can determine that the user has performed the work of unloading the sheets P and removed the sheets P on the sheet discharge tray 121. Meanwhile, when there are sheets P on the sheet discharge tray 121 in the stacker case 112 after the opening and closing of the door of the stacker case 112, the controller 6 can determine that the user has returned the wheeled platform 131 into the stacker case 112 and closed the door with the sheets P left on the sheet discharge tray 121.

Note that, in the printing apparatus LA, since the sheet discharging to the other stacker 111 is possible also during the work of unloading the sheets P from the stacker 111, the print operation can be continued.

When the controller 6 determines that there are sheets P on the sheet discharge tray 121 not being the current sheet discharge destination in step S65 (step S65: YES), the controller 6 returns to step S61.

When the controller 6 determines that there are no sheets P on the sheet discharge tray 121 not being the current sheet discharge destination (step S65: NO), in step S66, the controller 6 lifts this sheet discharge tray 121 to the upper limit position. Specifically, the controller 6 lifts the sheet discharge tray 121 not being the current sheet discharge destination and stops the lifting of the sheet discharge tray 121 when the top surface detection sensor 127 for this sheet discharge tray 121 turns on.

Next, in step S67, the controller 6 turns on an unloading execution flag. The series of processes is thereby completed. The unloading execution flag indicates whether the user has executed the work of unloading the sheets P from the large-capacity sheet discharger 4A. The unloading execution flag is turned on when the user executes the work of unloading the sheets P from the large-capacity sheet discharger 4A.

Next, control of the external sheet feeder 2 in the case where the work of unloading the sheets P from the large-capacity sheet discharger 4A is performed is described with reference to the flowchart of FIG. 13.

Figure 13:
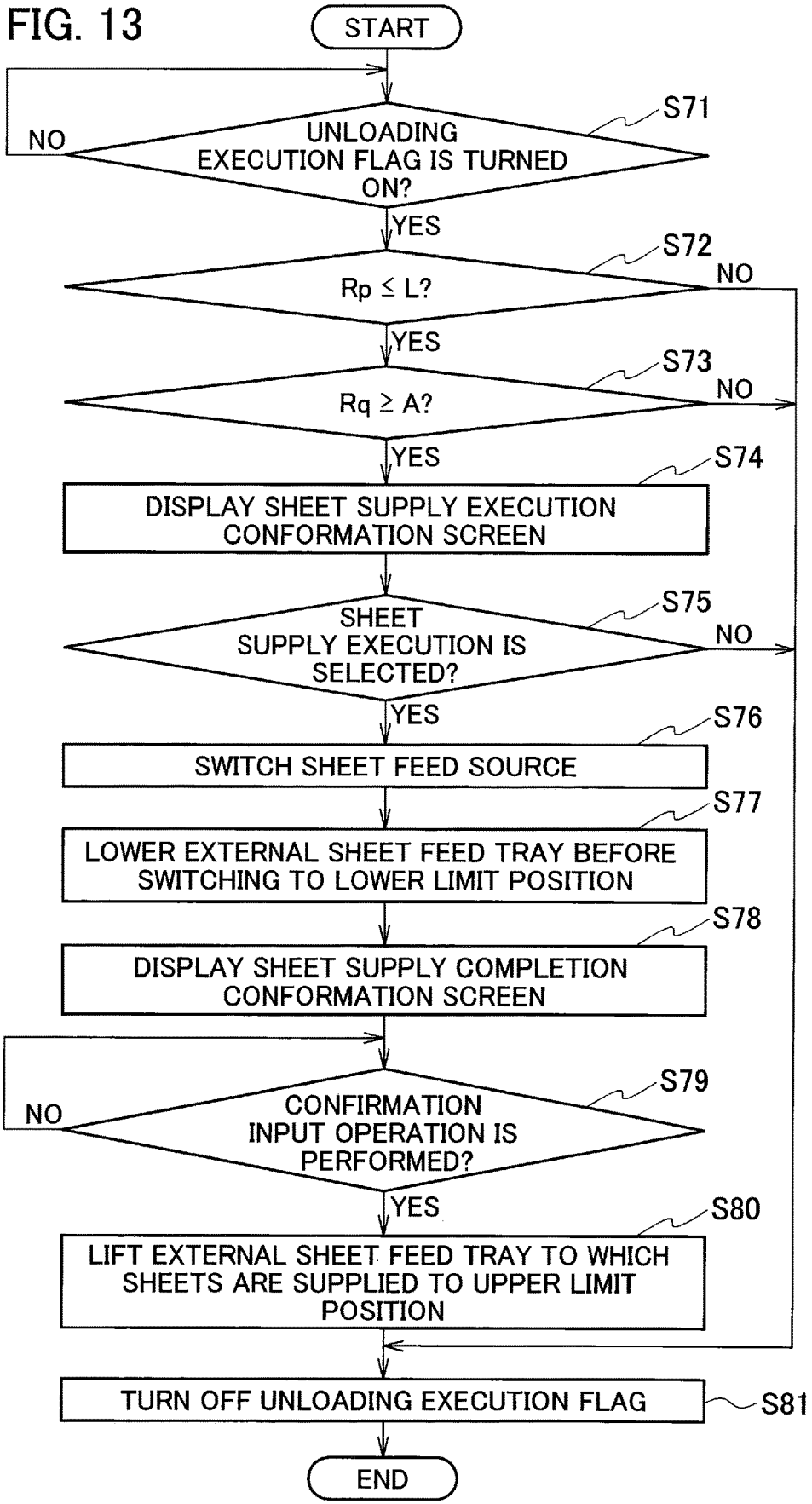
FIG. 13 is a flowchart of control of the external sheet feeder performed in execution of work of unloading the sheets from the large-capacity sheet discharger in the third embodiment.

In step S71 of FIG. 13, the controller 6 determines whether the unloading execution flag turns on. When the controller 6 determines that the unloading execution flag is not on (step S71: NO), the controller 6 repeats step S71.

When the controller 6 determines that the unloading execution flag is turned on (step S71: YES), the controller 6 executes processing of step S72. The processing of step S72 is the same as the processing of step S32 in FIG. 7 described in the first embodiment. In this case, in the printing apparatus 1A, the external sheet feed tray 11 being the current sheet feed source corresponds to the external sheet feed tray 11 being the latest sheet feed source.

When the controller 6 determines that $Rp \leq L$ in step S72 (step S72: YES), the controller 6 executes processing of step S73. The processing of step S73 is the same as the processing of step S33 in FIG. 7 described in the first embodiment.

When the controller 6 determines that $Rq \geq A$ in step S73 (step S73: YES), in step S74, the controller 6 displays, on the display unit of the operation panel 38, a sheet supply execution confirmation screen (not illustrated).

The sheet supply execution confirmation screen is a screen confirming with the user about whether the sheets P are to be supplied to the external sheet feeder 2. One of the external sheet feed trays 11A, 11B to which the sheets P are to be supplied is displayed in the sheet supply execution confirmation screen. The user performs an operation on the operation panel 38 according to an instruction displayed on the sheet supply execution confirmation screen to select whether to execute the supplying of the sheets P to the external sheet feeder 2.

Next, in step S75, the controller 6 determines whether execution of the supplying of the sheets P to the external sheet feeder 2 is selected.

When the controller 6 determines that the execution of the supplying of the sheets P is selected (step S75: YES), in step S76, the controller 6 switches the sheet feed source from the external sheet feed tray 11 being the latest sheet feed source (current sheet feed source) to the other external sheet feed tray 11.

Next, in step S77, the controller 6 lowers the external sheet feed tray 11 being the sheet feed source before the switching to the lower limit position. The user supplies the sheets P to the external sheet feed tray 11 lowered to the lower limit position.

Then, in step S78, the controller 6 displays, on the display unit of the operation panel 38, a sheet supply completion confirmation screen (not illustrated).

The sheet supply completion confirmation screen is a screen to which the user having completed the supplying of the sheets P inputs the completion of the supplying so that the printing apparatus 1A can confirm about the supplying of the sheets P to the external sheet feed tray 11. The user performs an input operation for the confirmation about the completion of the supplying of the sheets P on the operation panel 38 according to an instruction displayed on the sheet supply completion confirmation screen.

Next, in step S79, the controller 6 determines whether the input operation for the confirmation about the completion of the supplying of the sheets P is performed. When the controller 6 determines that the input operation for the confirmation is not performed (step S79: NO), the controller 6 repeats step S79.

When the controller 6 determines that the input operation for the confirmation is performed (step S79: YES), in step S80, the controller 6 lifts the external sheet feed tray 11 to which the sheets P are supplied to the upper limit position.

Then, in step S81, the controller 6 turns off the unloading execution flag. The series of processes is thereby completed.

When the controller 6 determines that: Rp>L in step S72 (step S72: NO); Rq<A in step S73 (step S73: NO); or non-execution of the supplying of the sheets P is selected in step S75 (step S75: NO), the controller 6 proceeds to step S81 and turns off the unloading execution flag. The series of processes is thereby completed.

As described above, in the third embodiment, in the execution of the work of unloading the sheets P from the large-capacity sheet discharger 4A, that is in the unloading of the sheets P from the large-capacity sheet discharger 4A, the controller 6 determines whether to perform the switching of the external sheet feed tray 11 being the sheet feed source, based on the sheet remaining amount Rp in the external sheet feed tray 11 being the latest sheet feed source (current sheet feed source) and the sheet remaining amount Rq in the other external sheet feed tray 11. When determining to perform the switching of the sheet feed source, the controller 6 controls the external sheet feeder 2 such that the sheet feed source is switched from the external sheet feed tray 11 being the latest sheet feed source to the other external sheet feed tray 11 if the user selects the execution of the supplying of the sheets P to the external sheet feeder 2.

This allows the user to perform work of removing the discharged sheets P and supply the sheets P to the external sheet feed tray 11 with a small sheet remaining amount without stopping the print operation to supply the sheets P to the external sheet feed tray 11 as in the first embodiment. As a result, it is possible to reduce the occurrence of the situation where the print operation is stopped due to the running-out of sheets P in the external sheet feed tray 11 and the printing apparatus 1 waits to be supplied with the sheets P, as in the first embodiment. Accordingly, a decrease in printed sheet productivity can be reduced.

Specifically, if the sheet remaining amount Rp in the external sheet feed tray 11 which is the latest sheet feed source (current sheet feed source) is the supply reference value L or less and the sheet remaining amount Rq in the other external sheet feed tray 11 is the sheet feed reference value A or more in unloading of the sheets P from the large-capacity sheet discharger 4A, the controller 6 determines to perform the switching of the sheet feed source from the external sheet feed tray 11 being the latest sheet feed source to the other external sheet feed tray 11, as in the first embodiment. As a result, it is possible to properly determine whether to perform the switching of the sheet feed source for supply of sheets depending on the sheet remaining amounts of the respective external sheet feed trays 11, as in the first embodiment. Accordingly, a frequency of supply of sheets can be decreased.

Moreover, when the sheet feed source is switched from the external sheet feed tray 11 being the latest sheet feed source to the other external sheet feed tray 11, the controller 6 lowers the external sheet feed tray 11 being the sheet feed source before the switching to the lower limit position, as in the first embodiment. This facilitates the work of supplying the sheets P to the external sheet feed tray 11 being the sheet feed source before the switching as in the first embodiment.

Furthermore, since the printing apparatus 1A includes two sheet discharge trays 121 and the two sheet discharge trays 121 are selectively used as the sheet discharge destination, the print operation can be continuously performed.

Next, a fourth embodiment is described in which the control of the external sheet feeder 2 performed in the execution of the work of unloading the sheets P from the large-capacity sheet discharger 4A is changed from that in the third embodiment.

Figure 14:
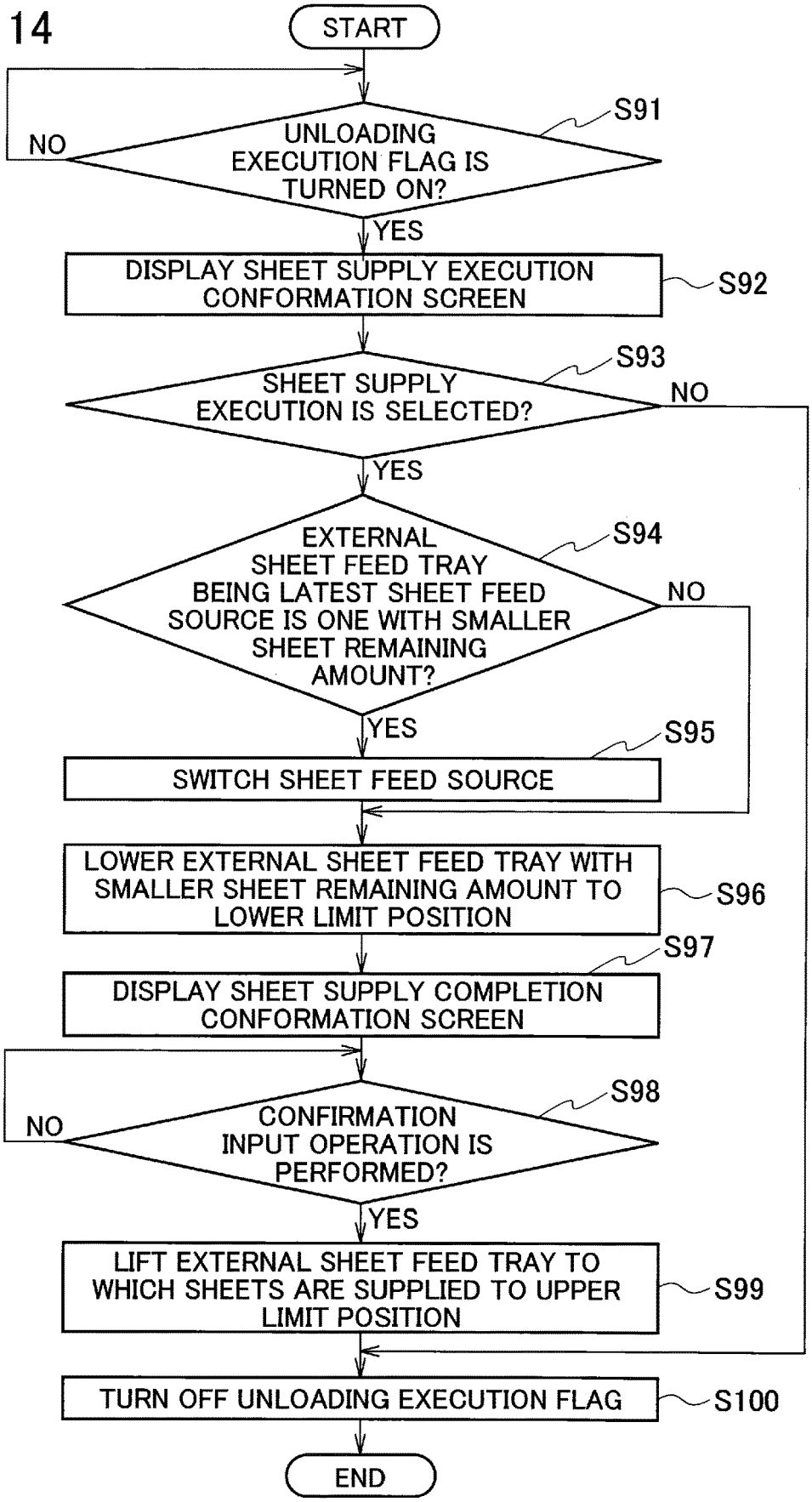
FIG. 14 is a flowchart of control of the external sheet feeder performed in the execution of work of unloading the sheets from the large-capacity sheet discharger in a fourth embodiment.

FIG. 14 is a flowchart of the control of the external sheet feeder 2 performed in the execution of the work of unloading the sheets P from the large-capacity sheet discharger 4A in the fourth embodiment.

Processing of step S91 in FIG. 14 is the same as the processing of step S71 in FIG. 13 described in the third embodiment.

In step S91, when the controller 6 determines that the unloading execution flag is turned on in step S91 (step S91: YES), the controller 6 executes processing of steps S92, S93. The processing of steps S92, S93 are the same as the processing of steps S74, S75 in FIG. 13 described in the third embodiment.

In step S93, when the controller 6 determines that the execution of the supplying of the sheets P is selected (step S93: YES), in step S94, the controller 6 determines whether the external sheet feed tray 11 being the latest sheet feed source is the external sheet feed tray 11 with the smaller sheet remaining amount. In this case, as described above, in the printing apparatus LA, the external sheet feed tray 11 being the current sheet feed source corresponds to the external sheet feed tray 11 being the latest sheet feed source.

When the controller 6 determines that the external sheet feed tray 11 being the latest sheet feed source is the external sheet feed tray 11 with the smaller sheet remaining amount (step S94: YES), in step S95, the controller 6 switches the sheet feed source from the external sheet feed tray 11 being the latest sheet feed source (current sheet feed source) to the other external sheet feed tray 11.

Next, in step S96, the controller 6 lowers one of the external sheet feed trays 11A, 11B with the smaller sheet remaining amount to the lower limit position. The user supplies the sheets P to the external sheet feed tray 11 lowered to the lower limit position.

When the controller 6 determines that the external sheet feed tray 11 being the latest sheet feed source is the external sheet feed tray 11 with the larger sheet remaining amount in step S94 (step S94: NO), the controller 6 skips step S95 and executes processing of step S96.

After step S96, the controller 6 executes processing of steps S97 to S100. The series of processes is thereby completed. The processing of steps S97 to S100 is the same as the processing of steps S78 to S81 in FIG. 13 described in the third embodiment.

When the controller 6 determines that non-execution of the supplying of the sheets P is selected in step S93 (step S93: NO), the controller 6 proceeds to step S100 and turns off the unloading execution flag. The series of processes is thereby completed.

As described above, in the fourth embodiment, in the execution of the work of unloading the sheets P from the large-capacity sheet discharger 4A, that is in the unloading of the sheets P from the large-capacity sheet discharger 4A, if the user selects the execution of the supplying of the sheets P to the external sheet feeder 2 and the external sheet feed tray 11 being the latest sheet feed source (current sheet feed source) is the external sheet feed tray 11 with the smaller sheet remaining amount, the controller 6 controls the external sheet feeder 2 such that the sheet feed source is switched from the external sheet feed tray 11 being the latest sheet feed source to the other external sheet feed tray 11.

Also in the fourth embodiment as in the second embodiment, the controller 6 determines whether the external sheet feed tray 11 being the latest sheet feed source is the external sheet feed tray 11 with the smaller sheet remaining amount and, based on the determination, determines whether to perform the switching of the sheet feed source. That is, the controller 6 determines whether to perform the switching of the sheet feed source based on the sheet remaining amount Rp in the external sheet feed tray 11 being the latest sheet feed source and the sheet remaining amount Rq in the other external sheet feed tray 11. When determining to perform the switching, the controller 6 controls the external sheet feeder 2 such that the sheet feed source is switched from the external sheet feed tray 11 being the latest sheet feed source to the other external sheet feed tray 11.

This allows the user to perform work of removing the discharged sheets P and supply the sheets P to the external sheet feed tray 11 without stopping the print operation to supply the sheets P to the external sheet feed tray 11 in the fourth embodiment, as in the first embodiment. As a result, it is possible to reduce the occurrence of the situation where the print operation is stopped due to the running-out of sheets P in the external sheet feed tray 11 and the printing apparatus 1 waits to be supplied with the sheets P. Accordingly, the decrease in printed sheet productivity can be reduced.

As described above, the controller 6 determines to perform the switching of the sheet feed source when the external sheet feed tray 11 being the latest sheet feed source is the external sheet feed tray 11 with the smaller sheet remaining amount if the user selects the execution of the supplying of the sheets P to the external sheet feeder 2 in the unloading of the sheets P from the large-capacity sheet discharger 4A. This allows the user to supply the sheets P to the external sheet feed tray 11 with the smaller sheet remaining amount at every performance of work of removing the discharged sheets P in case where the user selects the execution of the supplying of the sheets P to the external sheet feeder 2. Accordingly, a frequency of occurrence of running-out of sheets P can be decreased.

Moreover, in the unloading of the sheets P from the large-capacity sheet discharger 4A, if the user selects the execution of the supplying of the sheets P to the external sheet feeder 2, the controller 6 lowers the external sheet feed tray 11 with the smaller sheet remaining amount to the lower limit position. This facilitates the work of supplying the sheets P to the external sheet feed tray 11 with the smaller sheet remaining amount as in the second embodiment.

Although the present invention is described above by using the first to fourth embodiments, the present invention is not limited by these embodiments.

In the first and third embodiment, the supply reference value L is a value set in advance (fixed value). However, assume a case where, in the unloading of the sheets P from the large-capacity sheet discharger 4, 4A, the controller 6 knows the number of sheets to be subjected to printing before the next unloading of the sheets P from the large-capacity sheet discharger 4, 4A. In this case, this number of sheets to be subjected to printing may be used as the supply reference value L.

For example, assume a case where, in the first embodiment, the unloading operation is executed by the conveyor 5 in response to the completion of the print job. In this case, when the next print job is inputted into the controller 6, the number of sheets to be subjected to printing in the next print job or the capacity of the large-capacity sheet discharger 4 is the number of sheets to be subjected to printing before the next unloading of the sheets P. Since the controller 6 knows this number of sheets to be subjected to printing from the print job, the number of sheets to be subjected to printing may be used as the supply reference value L.

Moreover, for example, assume a case where, in the third embodiment, the sheet discharge destination is switched in response to the completion of the print job and the user unloads the sheets P on the sheet discharge tray 121 being the sheet discharge destination before the switching. In this case, when the next print job is inputted into the controller 6, the number of sheets to be subjected to printing in the next print job or the capacity of the stacker 111 is the number of sheets to be subjected to printing before the next unloading of the sheets P. Since the controller 6 can know this number of sheets to be subjected to printing from the print job, the number of sheets to be subjected to printing may be used as the supply reference value L.

Furthermore, for example, assume a case where, in the first embodiment, the conveyor 5 executes the unloading operation in response to the large-capacity sheet discharger 4 becoming full. In this case, when the next unloading operation is to be performed in response to the completion of the currently-executed print job, the controller 6 can know the remaining number of sheets to be subjected to printing before the next unloading operation, from the print job. Accordingly, the controller 6 may use this number of sheets to be subjected to printing as the supply reference value L.

Moreover, for example, assume a case where, in the third embodiment, the sheet discharge destination is switched in response to the sheet discharge tray 121 being the current sheet discharge destination becoming full and the user unloads the sheets P on the sheet discharge tray 121 being the sheet discharge destination before the switching. In this case, when the next switching of the sheet discharge destination and the next unloading of the sheets P are to be performed in response to the completion of the currently-executed print job, the controller 6 can know the remaining number of sheets to be subjected to printing before the next unloading of the sheets P, from the print job. Accordingly, the controller 6 may use this number of sheets to be subjected to printing as the supply reference value L.

Using the number of sheets to be subjected to printing before the next unloading of the sheets P from the large-capacity sheet discharger 4, 4A as the supply reference value L as described above can reduce the unnecessary lowering operation of the external sheet feed tray 11 and switching of the sheet feed source.

Moreover, although the configuration in which the external sheet feeder 2 has two external sheet feed trays 11 is described in the first to fourth embodiments, the external sheet feeder 2 may have three or more external sheet feed trays 11.

In this case, the controller 6 determines whether to perform the switching of the external sheet feed tray 11 being the sheet feed source, based on the sheet remaining amount in the external sheet feed tray 11 being the latest sheet feed source and the sheet remaining amounts in the other external sheet feed trays 11 in unloading of the sheets P from the large-capacity sheet discharger 4, 4A. When determining to perform the switching of the sheet feed source, the controller 6 controls the external sheet feeder 2 such that the sheet feed source is switched from the external sheet feed tray 11 being the latest sheet feed source to any one of the other external sheet feed trays 11.

Specifically, in the first embodiment, in a case where the external sheet feeder 2 has a configuration including three or more external sheet feed trays 11, in the execution of the unloading operation by the conveyor 5, that is in the unloading of the sheets P from the large-capacity sheet discharger 4, if the sheet remaining amount in the external sheet feed tray 11 being the latest sheet feed source is the supply reference value L or less and there is an external sheet feed tray 11 with a sheet remaining amount equal to or more than the sheet feed reference value A among the other external sheet feed trays 11, the controller 6 determines to perform the switching of the sheet feed source and lowers the external sheet feed tray 11 being the latest sheet feed source to the lower limit position. Then, the controller 6 controls the external sheet feeder 2 such that the sheet feed source after the completion of the unloading operation is switched from the external sheet feed tray 11 being the latest sheet feed source to the external sheet feed tray 11 with the sheet remaining amount equal to or more than the sheet feed reference value A.

Moreover, assume a case where, in the second embodiment, the external sheet feeder 2 has a configuration including three or more external sheet feed trays 11. In this case, in the execution of the unloading operation by the conveyor 5, that is in the unloading of the sheets P from the large-capacity sheet discharger 4, the controller 6 lowers the external sheet feed tray 11 with the smallest sheet remaining amount to the lower limit position. Then, if the external sheet feed tray 11 being the latest sheet feed source is the external sheet feed tray 11 with the smallest sheet remaining amount, the controller 6 controls the external sheet feeder 2 such that the sheet feed source after the completion of the unloading operation is switched from the external sheet feed tray 11 being the latest sheet feed source to another external sheet feed tray 11.

Furthermore, in the third embodiment, in a case where the external sheet feeder 2 has a configuration including three or more external sheet feed trays 11, in the execution of the work of unloading the sheets P from the large-capacity sheet discharger 4A, that is in the unloading of the sheets P from the large-capacity sheet discharger 4A, if the sheet remaining amount in the external sheet feed tray 11 being the latest sheet feed source is the supply reference value L or less and there is an external sheet feed tray 11 with a sheet remaining amount equal to or more than the sheet feed reference value A among the other external sheet feed trays 11, the controller 6 determines to perform the switching of the sheet feed source. And then, the controller 6 controls the external sheet feeder 2 such that the sheet feed source is switched from the external sheet feed tray 11 being the latest sheet feed source to the external sheet feed tray 11 with the sheet remaining amount equal to or more than the sheet feed reference value A if the user selects the execution of the supplying of the sheets P to the external sheet feeder 2. Moreover, the controller 6 lowers the external sheet feed tray 11 being the sheet feed source before the switching to the lower limit position.

Moreover, assume a case where, in the fourth embodiment, the external sheet feeder 2 has a configuration including three or more external sheet feed trays 11. In this case, in the execution of the work of unloading the sheets P from the large-capacity sheet discharger 4A, that is in the unloading of the sheets P from the large-capacity sheet discharger 4A, if the user selects the execution of the supplying of the sheets P to the external sheet feeder 2 and the external sheet feed tray 11 being the latest sheet feed source is the external sheet feed tray 11 with the smallest sheet remaining amount, the controller 6 controls the external sheet feeder 2 such that the sheet feed source is switched from the external sheet feed tray 11 being the latest sheet feed source to another external sheet feed tray 11. Moreover, the controller 6 lowers the external sheet feed tray 11 with the smallest sheet remaining amount to the lower limit position irrespective of whether the sheet feed source is switched or not.

Furthermore, in the third and fourth embodiments, operations of displaying the sheet supply execution confirmation screen on the operation panel 38 and making the user select whether to execute the supplying of the sheets P can be omitted.

Specifically, in the third embodiment, in the unloading of the sheets P from the large-capacity sheet discharger 4A, if the sheet remaining amount Rp in the external sheet feed tray 11 being the latest sheet feed source is the supply reference value L or less and the sheet remaining amount Rq in the other external sheet feed tray 11 is the sheet feed reference value A or more, the controller 6 may switch the sheet feed source from the external sheet feed tray 11 being the latest sheet feed source to the other external sheet feed tray 11 without condition. Moreover, in this case, as in the first embodiment, when the sheet feed source is switched from the external sheet feed tray 11 being the latest sheet feed source to the other external sheet feed tray 11, the notification lamp 37 may notify the user that it is time to supply the sheets P to the external sheet feed tray 11.

Moreover, assume the case where, in the third embodiment, the external sheet feeder 2 has the configuration including three or more external sheet feed trays 11. In this case, in the unloading of the sheets P from the large-capacity sheet discharger 4A, if the sheet remaining amount in the external sheet feed tray 11 being the latest sheet feed source is the supply reference value L or less and there is an external sheet feed tray 11 with a sheet remaining amount equal to or more than the sheet feed reference value A among the other external sheet feed trays 11, the controller 6 may switch the sheet feed source from the external sheet feed tray 11 being the latest sheet feed source to the external sheet feed tray 11 with the sheet remaining amount equal to or more than the sheet feed reference value A without condition.

Furthermore, in the fourth embodiment, in the unloading of the sheets P from the large-capacity sheet discharger 4A, if the external sheet feed tray 11 being the latest sheet feed source is the external sheet feed tray 11 with the smaller sheet remaining amount, the controller 6 may switch the sheet feed source from the external sheet feed tray 11 being the latest sheet feed source to the other external sheet feed tray 11 without condition. Moreover, in this case, as in the second embodiment, in the unloading of the sheets P from the large-capacity sheet discharger 4A, the notification lamp 37 may notify the user that it is time to supply the sheets P to the external sheet feed tray 11.

Moreover, assume the case where, in the fourth embodiment, the external sheet feeder 2 has the configuration including three or more external sheet feed trays 11. In this case, in the unloading of the sheets P from the large-capacity sheet discharger 4A, if the external sheet feed tray 11 being the latest sheet feed source is the external sheet feed tray 11 with the smallest sheet remaining amount, the controller 6 may switch the sheet feed source from the external sheet feed tray 11 being the latest sheet feed source to the other external sheet feed tray 11 without condition.

Furthermore, in the first and second embodiments, the sheet supply execution confirmation screen may be displayed on the operation panel 38 to make the user select whether to execute the supplying of the sheets P as in the third and fourth embodiments.

Furthermore, in the first embodiment, the controller 6 may determine to perform the switching of the sheet feed source from the external sheet feed tray 11 being the latest sheet feed source to the other external sheet feed tray 11 when the sheet remaining amount Rq in the other external sheet feed tray 11 is greater than the sheet remaining amount Rp in the external sheet feed tray 11 which is the latest sheet feed source regardless of how much the sheet remaining amount Rp is. The same applies to the third embodiments. As a result, it is still possible to properly determine whether to perform the switching of the sheet feed source for supply of sheets depending on the sheet remaining amounts of the respective external sheet feed trays 11. Accordingly, a frequency of supply of sheets can be decreased.

Furthermore, in a case where the external sheet feeder 2 includes three or more external sheet feed trays 11 in the first embodiment, the controller 6 may determine to perform the switching of the sheet feed source from the external sheet feed tray 11 being the latest sheet feed source to the external sheet feed tray 11 having the sheet remaining amount greater than the sheet remaining amount of the external sheet feed tray 11 being the latest sheet feed source when the external sheet feed tray 11 having the sheet remaining amount greater than the sheet remaining amount of the external sheet feed tray 11 being the latest sheet feed source exists. The same applies to a case where the external sheet feeder 2 includes three or more external sheet feed trays 11 in the third embodiment.

Moreover, in the first to fourth embodiments, the external sheet feeder 2 may be configured such that supplying of the sheets P is possible without lowering the external sheet feed trays 11 and the operation of lowering the external sheet feed tray 11 to the lower limit position to supply the sheets P is omitted.

Furthermore, in third and fourth embodiments, there may be provided an unloader which unloads the sheets P from the stackers 111 of the large-capacity sheet discharger 4A. For example, the configuration may be such that the sheet discharge trays 121 are formed of belt conveyors and each sheet discharge tray 121 is provided with an unloader formed of a belt conveyor configured to unload the sheets P from the sheet discharge tray 121.

Moreover, although the configuration in which one printing apparatus main body 3 is provided between the external sheet feeder 2 and the large-capacity sheet discharger 4 is described in the first and second embodiments, a configuration in which multiple printing apparatus main bodies 3 are connected to one another may be employed. This also applies to the third and fourth embodiments.

The embodiments of the present disclosure have, for example, the following configurations.

A printing apparatus in accordance with some embodiments includes: a printer configured to perform printing on sheets; a sheet feeder including sheet feed trays and configured to feed the sheets from a selected one of the sheet feed trays to the printer; a sheet discharger configured to discharge and hold the sheets printed by the printer; and a controller. Upon unloading of the sheets from the sheet discharger, the controller is configured to: determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray; and upon determining to perform the switching, control the sheet feeder to switch the sheet feed source from the first sheet feed tray to the second sheet feed tray.

The controller may be configured to determine to perform the switching upon the first sheet remaining amount being a supply reference value or less and the second sheet remaining amount being a sheet feed reference value or more.

Upon the unloading of the sheets from the sheet discharger and upon the controller knowing a number of sheets to be subjected to printing prior to next unloading of the sheets from the sheet discharger, the controller may be configured to use the number of sheets to be subjected to printing as the supply reference value.

The controller may be configured to determine to perform the switching when the first sheet remaining amount is smaller than the second sheet remaining amount.

Each of the sheet feed trays may be capable of being lifted and lowered, and the controller may be configured to lower the first sheet feed tray to a sheet supply position upon performing the switching.

The printing apparatus may further include a notifier configured to notify a user of a timing to supply sheets to the sheet feed trays. Upon the unloading of the sheets from the sheet discharger and upon performing the switching, the controller may be configured to control the notifier to notify the user that it is a timing to supply the sheets to the first sheet feed tray.

The controller may be configured to determine to perform the switching upon the first sheet remaining amount of the first sheet feed tray being smallest among sheet remaining amounts of the sheet feed trays.

Each of the sheet feed trays may be capable of being lifted and lowered, and the controller may be configured to lower a sheet feed tray of the sheet feed trays with a smallest sheet remaining amount to a sheet supply position upon the unloading of the sheets from the sheet discharger.

The printing apparatus may further include a notifier configured to notify a user of a timing to supply sheets to the sheet feeder. Upon the unloading of the sheets from the sheet discharger, the controller may be configured to control the notifier to notify the user that it is the timing to supply the sheets to the sheet feeder.

The sheet discharger may include sheet discharge trays on which the discharged sheets are stacked and is configured to selectively use one of the sheet discharge trays as a sheet discharge destination.

The printing apparatus may further include an unloader configured to unload the sheets from the sheet discharger.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing apparatus comprising:

a printer configured to perform printing on sheets;

a sheet feeder including sheet feed trays and configured to feed the sheets from a selected one of the sheet feed trays to the printer;

a sheet discharger configured to discharge and hold the sheets printed by the printer; and a controller configured to, in response to unloading of the sheets from the sheet discharger, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

2. The printing apparatus according to claim 1, wherein the controller is configured to determine to perform the switching upon the first sheet remaining amount being a supply reference value or less and the second sheet remaining amount being a sheet feed reference value or more.

3. The printing apparatus according to claim 2, wherein upon the unloading of the sheets from the sheet discharger and upon the controller knowing a number of sheets to be subjected to printing prior to next unloading of the sheets from the sheet discharger, the controller is configured to use the number of sheets to be subjected to printing as the supply reference value.

4. The printing apparatus according to claim 2, wherein each of the sheet feed trays is capable of being lifted and lowered, and the controller is configured to lower the first sheet feed tray to a sheet supply position upon performing the switching.

5. The printing apparatus according to claim 1, wherein the controller is configured to determine to perform the switching when the first sheet remaining amount is smaller than the second sheet remaining amount.

6. The printing apparatus according to claim 1, further comprising a notifier configured to notify a user of a timing to supply sheets to the sheet feed trays, wherein, upon the unloading of the sheets from the sheet discharger and upon performing the switching, the controller is configured to control the notifier to notify the user that it is a timing to supply the sheets to the first sheet feed tray.

7. The printing apparatus according to claim 1, wherein the controller is configured to determine to perform the switching upon the first sheet remaining amount of the first sheet feed tray being smallest among sheet remaining amounts of the sheet feed trays.

8. The printing apparatus according to claim 7, wherein each of the sheet feed trays is capable of being lifted and lowered, and the controller is configured to lower a sheet feed tray of the sheet feed trays with a smallest sheet remaining amount to a sheet supply position upon the unloading of the sheets from the sheet discharger.

9. The printing apparatus according to claim 7, further comprising a notifier configured to notify a user of a timing to supply sheets to the sheet feeder, wherein, upon the unloading of the sheets from the sheet discharger, the controller is configured to control the notifier to notify the user that it is the timing to supply the sheets to the sheet feeder.

10. The printing apparatus according to claim 1, wherein the sheet discharger comprises sheet discharge trays on which the discharged sheets are stacked and is configured to selectively use one of the sheet discharge trays as a sheet discharge destination.

11. The printing apparatus according to claim 1, further comprising an unloader configured to unload the sheets from the sheet discharger.

12. The printing apparatus according to claim 1, wherein the controller is configured to, instruct the sheet discharger to move sheets held thereby to a conveyor and instruct the conveyor to move sheets received from the sheet discharger away from the sheet discharger, thereby unloading the sheets from the sheet discharger, when the sheet discharger is full, and in response to instructing the sheet discharger to move sheets held thereby to a conveyor and instructing the conveyor to move sheets received from the sheet discharger away from the sheet discharger, thereby unloading the sheets from the sheet discharger, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

13. The printing apparatus according to claim 1, wherein the controller is configured to, after instructing the sheet discharger to move sheets held thereby to a conveyor, and instructing the conveyor to move sheets received from the sheet discharger away from the sheet discharger, thereby unloading the sheets from the sheet discharger, when the sheet discharger is full determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

14. The printing apparatus according to claim 1, wherein the controller is configured to, instruct the sheet discharger to move sheets held thereby to a conveyor and instruct the conveyor to move sheets received from the sheet discharger away from the sheet discharger, thereby unloading the sheets from the sheet discharger, when the sheet discharger is full, and after instructing the sheet discharger to move sheets held thereby to a conveyor and instructing the conveyor to move sheets received from the sheet discharger away from the sheet discharger, thereby unloading the sheets from the sheet discharger determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

15. The printing apparatus according to claim 1, wherein the controller is configured to, in response to determining that the sheet discharger is full, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

16. The printing apparatus according to claim 1, wherein the controller is configured to, determine when the sheet discharger is full, and in response to determining that the sheet discharger is full, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

17. The printing apparatus according to claim 1, wherein the controller is configured to, in response to unloading of the sheets from the sheet discharger by lowering the sheet discharger to its lower limit position, moving a conveyor adjacent the sheet discharger, and feeding the sheets from the sheet discharger to the moving conveyor, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

18. The printing apparatus according to claim 1, wherein the controller is configured to, instruct unloading the sheets from the sheet discharger when the sheet discharger is full by lowering the sheet discharger to its lower limit position, moving a conveyor adjacent the sheet discharger, and feeding the sheets from the sheet discharger to the moving conveyor, and in response to lowering the sheet discharger to its lower limit position, moving a conveyor adjacent the sheet discharger, and feeding the sheets from the sheet discharger to the moving conveyor, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

19. The printing apparatus according to claim 1, wherein the controller is configured to, in response to turning on an unloading operation execution flag, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

20. The printing apparatus according to claim 1, wherein the controller is configured to, turn on an unloading operation execution flag when unloading of the sheets from the sheet discharger, and in response to turning on the unloading operation execution flag, determine whether to perform switching of a sheet feed source from a first sheet feed tray which is a latest sheet feed source of the sheet feed trays to a second sheet feed tray which is a sheet feed tray other than the first sheet feed tray of the sheet feed trays, based on a first sheet remaining amount in the first sheet feed tray and a second sheet remaining amount in the second sheet feed tray, and upon determining to perform the switching, control the sheet feeder to switch the sheet feed source from the first sheet feed tray to the second sheet feed tray.

* * * * *